US008747253B2

(12) United States Patent
Stites

(10) Patent No.: US 8,747,253 B2
(45) Date of Patent: Jun. 10, 2014

(54) GOLF CLUB HEAD OR OTHER BALL STRIKING DEVICE HAVING ADJUSTABLE WEIGHTING FEATURES

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 509 days.

(21) Appl. No.: 12/895,375

(22) Filed: Sep. 30, 2010

(65) Prior Publication Data

US 2012/0083359 A1 Apr. 5, 2012

(51) Int. Cl.
*A63B 53/04* (2006.01)
*A63B 53/06* (2006.01)

(52) U.S. Cl.
USPC ..... 473/334; 473/345; 473/349

(58) Field of Classification Search
USPC ..... 473/324–350
See application file for complete search history.

(56) References Cited

U.S. PATENT DOCUMENTS

| | | | | | |
|---|---|---|---|---|---|
| 1,213,382 | A | * | 1/1917 | Kent | 473/338 |
| 1,665,523 | A | | 4/1928 | Boyce | |
| 3,143,349 | A | * | 8/1964 | MacIntyre | 473/338 |
| 3,556,533 | A | * | 1/1971 | Hollis | 473/338 |
| 4,085,934 | A | * | 4/1978 | Churchward | 473/338 |
| 5,154,424 | A | * | 10/1992 | Lo | 473/338 |
| 5,518,243 | A | * | 5/1996 | Redman | 473/334 |
| 5,720,674 | A | * | 2/1998 | Galy | 473/345 |
| 5,911,638 | A | | 6/1999 | Parente et al. | |
| 5,916,042 | A | * | 6/1999 | Reimers | 473/334 |
| 5,976,033 | A | * | 11/1999 | Takeda | 473/334 |
| 6,089,994 | A | * | 7/2000 | Sun | 473/338 |
| 6,123,627 | A | * | 9/2000 | Antonious | 473/327 |
| 6,146,287 | A | * | 11/2000 | Rugge et al. | 473/334 |
| 6,306,048 | B1 | * | 10/2001 | McCabe et al. | 473/333 |
| 6,386,990 | B1 | | 5/2002 | Reyes et al. | |
| 6,409,612 | B1 | * | 6/2002 | Evans et al. | 473/324 |
| 6,527,650 | B2 | | 3/2003 | Reyes et al. | |
| 6,773,360 | B2 | * | 8/2004 | Willett et al. | 473/334 |
| 6,926,615 | B1 | * | 8/2005 | Souza et al. | 473/251 |
| 6,991,558 | B2 | * | 1/2006 | Beach et al. | 473/324 |
| 7,077,762 | B2 | * | 7/2006 | Kouno et al. | 473/314 |
| 7,153,220 | B2 | * | 12/2006 | Lo | 473/335 |
| 7,198,575 | B2 | * | 4/2007 | Beach et al. | 473/324 |

(Continued)

FOREIGN PATENT DOCUMENTS

| | | | | | |
|---|---|---|---|---|---|
| GB | 2133295 | A | * | 7/1984 | A63B 53/06 |
| JP | 06126004 | A | * | 5/1994 | A63B 53/06 |

(Continued)

OTHER PUBLICATIONS

ISR & WO from PCT application No. PCT/US2011/053252 mailed Feb. 13, 2012.

*Primary Examiner* — Alvin Hunter
(74) *Attorney, Agent, or Firm* — Banner & Witcoff, Ltd.

(57) ABSTRACT

A ball striking device, such as a golf club, includes a head with a face having an outer surface configured for striking a ball, a body connected to the face, and a plurality of inserts connected to the outer surface of the body. The plurality of inserts are removable and interchangeable with other inserts, and at least one of the inserts has a weight that is greater than at least another one of the inserts. The inserts may be substantially identical in size and shape to enable the inserts to be interchanged with each other. Additionally, one or more of the inserts may be a primary insert with a secondary insert connected to the primary insert.

34 Claims, 16 Drawing Sheets

(56) References Cited

U.S. PATENT DOCUMENTS

| | | | | |
|---|---|---|---|---|
| 7,291,074 | B2 * | 11/2007 | Kouno et al. | 473/314 |
| 7,410,428 | B1 | 8/2008 | Dawson et al. | |
| 7,491,131 | B2 * | 2/2009 | Vinton | 473/251 |
| 7,530,901 | B2 * | 5/2009 | Imamoto et al. | 473/334 |
| 7,530,903 | B2 * | 5/2009 | Imamoto et al. | 473/335 |
| 7,670,235 | B2 * | 3/2010 | Lo | 473/332 |
| 7,744,485 | B2 * | 6/2010 | Jones et al. | 473/324 |
| 7,824,280 | B2 * | 11/2010 | Yokota | 473/334 |
| 8,016,694 | B2 * | 9/2011 | Llewellyn et al. | 473/334 |
| 8,197,357 | B1 * | 6/2012 | Rice et al. | 473/334 |
| 8,197,358 | B1 * | 6/2012 | Watson et al. | 473/334 |
| 8,202,175 | B2 * | 6/2012 | Ban | 473/338 |
| 8,246,488 | B2 * | 8/2012 | Stevens et al. | 473/335 |
| 8,262,506 | B2 * | 9/2012 | Watson et al. | 473/334 |
| 8,388,465 | B2 * | 3/2013 | De La Cruz et al. | 473/334 |
| 2006/0105856 | A1 | 5/2006 | Lo | |
| 2007/0054751 | A1 | 3/2007 | Breier et al. | |
| 2008/0039228 | A1 | 2/2008 | Breier et al. | |
| 2010/0197426 | A1 | 8/2010 | De La Cruz et al. | |

FOREIGN PATENT DOCUMENTS

| | | | | | |
|---|---|---|---|---|---|
| JP | 11009742 | A | * | 1/1999 | A63B 53/06 |
| JP | 11290490 | A | * | 10/1999 | A63B 53/04 |
| JP | 11290492 | A | * | 10/1999 | A63B 53/06 |
| JP | 2000024149 | A | * | 1/2000 | A63B 53/06 |
| JP | 2001204861 | A | * | 7/2001 | A63B 53/04 |
| JP | 2001224713 | A | * | 8/2001 | A63B 53/04 |
| JP | 2005287679 | A | * | 10/2005 | A63B 53/06 |
| JP | 2006102053 | A | * | 4/2006 | |
| JP | 2006141710 | A | * | 6/2006 | |
| JP | 2006187489 | A | * | 7/2006 | |
| JP | 2006320493 | A | * | 11/2006 | |
| JP | 2009066071 | A | * | 4/2009 | |
| JP | 2010088807 | A | * | 4/2010 | |
| WO | 9622817 | | | 8/1996 | |

* cited by examiner

GOLF CLUB HEAD OR OTHER BALL STRIKING DEVICE HAVING ADJUSTABLE WEIGHTING FEATURES

TECHNICAL FIELD

The invention relates generally to ball striking devices, such as golf club heads, having inserts connected to the body of the head. Certain aspects of this invention relate to golf club heads having removable and/or interchangeable weighted inserts connected to the body thereof.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club should meet the golf ball square (or substantially square) to the desired target path. Moreover, the golf club should meet the golf ball at or close to a desired location on the club head face (i.e., on or near a "desired" or "optimal" ball contact location) to reliably fly straight, in the desired direction, and for a desired distance. Off-center hits that deviate from squared contact and/or are located away from the club's desired ball contact location may tend to "twist" the club face when it contacts the ball, thereby sending the ball in the wrong direction, often imparting undesired hook or slice spin, and/or robbing the shot of distance. Accordingly, club head features that can help a user keep the club face square with the ball would tend to help the ball fly straighter and truer, in the desired direction, and often with improved and/or reliable distance.

Various golf club heads have been designed to improve a golfer's accuracy by assisting the golfer in squaring the club head face at impact with a golf ball. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories. The distance and direction of ball flight can also be significantly affected by the spin imparted to the ball by the impact with the club head. Additionally, the spin of the ball can change the behavior of the ball as it rolls and bounces after impact with the ground. Various speeds and directions of spin on the ball can be a product of many factors, including the point of impact, the direction of the club head upon impact, the degree of twisting of the club head upon impact, and the location of the center of gravity of the club head.

The energy and velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, because golf clubs are typically designed to contact the ball at or around the center of the face, off-center hits may result in less energy being transferred to the ball, decreasing the distance of the shot.

The weighting and weight distribution of a golf club head may also influence the energy and velocity transferred to the ball by the impact, as well as the moment of inertia and the center of gravity of the club head. The moment of inertia of the head can be increased, for example, by distributing a greater amount of weight around the perimeter of the head. This, in turn, can reduce the amount of twisting of the club head that occurs on off-center hits, and increase the distance and accuracy of shots on off-center hits. Likewise, the location of the center of gravity of the head can be influenced by the weight distribution of the head. Generally, the desired contact area of the face is aligned with the center of gravity of the head. However, it may be desirable to shift the location of the center of gravity of the head, such as to adjust for common off-center hitting patterns by a golfer, or to produce a certain shot characteristic (e.g., hook, slice, draw, fade, etc.). Accordingly, club head features that can permit the weighting and weight distribution of the head to be adjusted or customized may provide improved performance in several ways.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of golf club heads described herein include a face having a ball striking surface configured for striking a ball, a body connected to the face, and a plurality of inserts connected to the outer surface of the body. The plurality of inserts are substantially identical in size to enable the inserts to be removed from the body and interchanged with each other, and at least one of the inserts has a weight that is greater than at least another one of the inserts.

According to one aspect, each of the inserts has a first end and a second end that is wider than the first end, and the inserts are positioned in a radiating arrangement on a sole of the body, such that the first ends of the inserts are positioned proximate a single point and the inserts radiate outwardly from the single point.

According to another aspect, the body has a plurality of recesses on the outer surface, and each of the inserts is received in one of the recesses. The recesses are substantially identical in size to enable each of the inserts to be received in any of the recesses.

According to a further aspect, the head further includes a plurality of secondary inserts, wherein each of the inserts has at least one secondary insert connected thereto. In one embodiment, each of the inserts has at least one cavity therein, and the secondary inserts are received in the cavities. In another embodiment, the secondary inserts are substantially identical in size, to enable the secondary inserts to be interchanged with each other, and the insert has cavities that are substantially identical in size to enable each of the secondary inserts to be received in any of the cavities. In a further embodiment, the secondary inserts may be conceptually separated into two groups, such that the secondary inserts of the first group are substantially identical in size, and the secondary inserts of the second group are substantially identical in size. Each of the inserts may have one secondary insert of the first group and one secondary insert of the second group connected thereto. In yet another embodiment, each of the inserts may have two cavities therein, such that the secondary inserts of the first group are received in the first cavities, and the secondary inserts of the second group are received in the second cavities. Further, each of the first cavities are substantially identical in size and each of the second cavities are substantially identical in size to enable each of the secondary inserts of the first group to be received in any of the first cavities and each of the secondary inserts of the second group to be received in any of the second cavities.

Additional aspects of the invention relate to golf club heads including a face having a ball striking surface configured for striking a ball, a body connected to the face, a removable primary insert connected to the outer surface of the body, and a secondary insert connected to the primary insert.

According to one aspect, the primary insert has a cavity therein, and the secondary insert is received within the cavity.

According to another aspect, the head further includes a second secondary insert connected to the primary insert. In one embodiment, the primary insert may have two cavities therein, and the secondary inserts are received within the cavities.

Further aspects of the invention relate to golf club heads including a face having a ball-striking surface configured for striking a ball, a body connected to the face, the body having an outer surface having a curved contour, and a plurality of inserts connected to the outer surface of the body. Each of the inserts is a thin plate member having an inner surface that has a curved contour that is cooperatively dimensioned with the outer surface of the body such that the inner surface of each insert engages the outer surface of the body in surface-to-surface engagement.

According to one aspect, the body has a rounded horizontal rear profile, and the inserts each have a rounded contour to conform to the horizontal rear profile of the body.

According to another aspect, the body has a generally rectangular horizontal rear profile including a first corner and a second corner. The plurality of inserts include at least a first insert having a generally squared contour to conform to the first corner, and a second insert having a generally squared contour to conform to the second corner. The plurality of inserts may also include one or more additional inserts positioned between the first and second inserts.

According to a further aspect, the body has a rounded horizontal rear profile, and the plurality of inserts are configured to change the shape of the horizontal rear profile when connected to the head. According to this aspect, the inserts may include a first insert having a generally squared contour to form a first generally squared corner, and a second insert having a generally squared contour to form a second generally squared corner, giving the head a generally rectangular horizontal rear profile.

Still further aspects of the invention relate to a wood-type golf club head including a face having a ball striking surface configured for striking a ball, a body connected to the face and extending rearward from the face to define a cavity bounded by the face and the body, wherein the body and the face enclose a volume of at least 400 cubic centimeters, and a plurality of inserts connected to the outer surface of the body. Each of the inserts having a first end and a second end that is wider than the first end, and the inserts are positioned in a radiating arrangement on a sole of the body, such that the first ends of the inserts are positioned proximate a single point and the inserts radiate outwardly from the single point. The plurality of inserts are substantially identical in size to enable the inserts to be removed from the body and interchanged with each other, and at least one of the inserts has a weight that is greater than at least another one of the inserts. The inserts may be connected to the body by threaded fasteners, or another manner to permit interchangeability.

According to one aspect, the head has a peripheral area extending around the face and the body, the peripheral area having an outer periphery of maximum size, and the second ends of the inserts are positioned within the peripheral area.

According to another aspect, the inserts include a first insert, a second insert, and a third insert, wherein the first ends of the first, second, and third inserts converge to the single point, and wherein the second insert is positioned between the first and third inserts such that the second end of the second insert and the second end of the first insert converge to a second point and the second end of the second insert and the second end of the third insert converge to a third point.

According to a further aspect, the outer surface of the body has a curved contour, and each of the inserts has an inner surface that has a curved contour that is cooperatively dimensioned with the outer surface of the body such that the inner surface of each insert engages the outer surface of the body in surface-to-surface engagement. In one embodiment, the body has a rounded horizontal rear profile, and the second ends of the inserts each have a rounded contour to conform to the horizontal rear profile of the body.

According to a still further aspect, the head further includes a plurality of secondary inserts, wherein each of the inserts has at least one secondary insert connected thereto. In one embodiment, each of the inserts has at least one cavity therein, and the secondary inserts are received in the cavities.

According to yet another aspect, the body includes a plurality of recesses on the outer surface, and each of the inserts is positioned within one of the recesses.

Other aspects of the invention relate to a golf club kit that includes a golf club head with a face, a body connected to the face, and at least one insert configured for connection to the body, as described above. According to one aspect, the kit may include a plurality of inserts that are interchangeable with each other. The interchangeable inserts may include inserts having different weights to allow the weighting of the head to be customized and/or inserts having different shapes to allow the shape of the head to be customized.

Still further aspects of the invention relate to a method in which a golf club head as described above is provided, including a face, a body connected to the face, and at least one removable insert is connected to the body. According to one aspect, the method may further include removing at least one insert from the body and replacing it with a different insert, which may have different characteristics, such as weight, shape, etc.

Still other aspects of the invention relate to a golf club that includes a head as described above and a shaft connected to the head. In one embodiment, the a wood-type golf club head may be used to create a wood-type golf club Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 11 is an exploded bottom view of a third illustrative embodiment of a head of a ball striking device according to the present invention, showing the connection of a plurality of primary inserts and secondary inserts to the head;

FIG. 21 is an exploded bottom view of a fifth illustrative embodiment of a head of a ball striking device according to the present invention, showing the connection of a plurality of inserts to the head.

DETAILED DESCRIPTION

Figure 1:
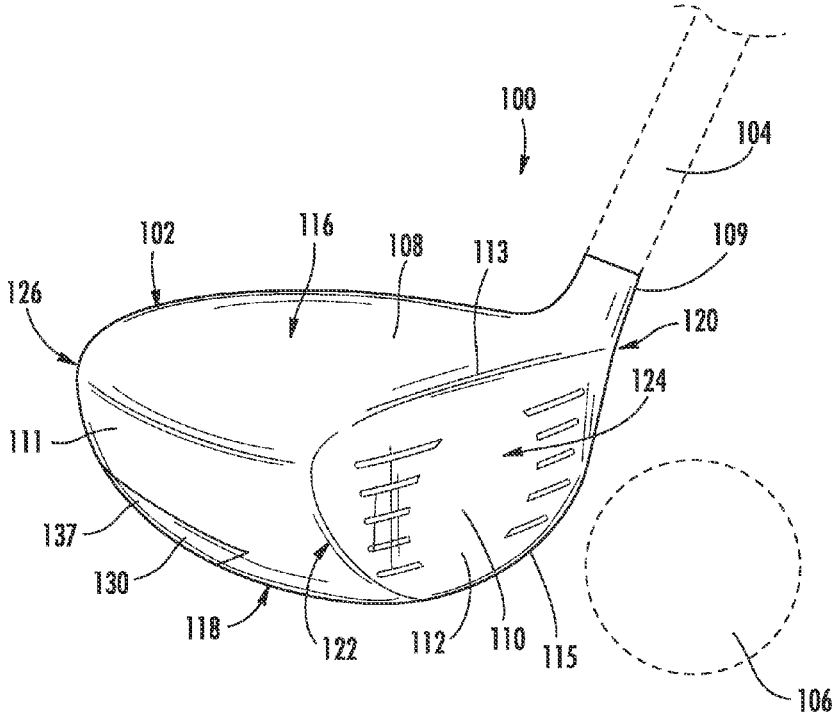
FIG. 1 is a top perspective view of an illustrative embodiment of a head of a ball striking device according to the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Substantially flush" means that a surface of one article is level and aligned with the surface of an adjacent article, such that the two surfaces form a substantially flat single surface, within a tolerance of +/−0.005 inches.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIG. 1, which illustrates one illustrative embodiment of a ball striking device 100 in the form of a golf driver, or other wood-type club. Generally, such wood-type drivers are capable of hitting a ball accurately over long distances.

Figure 2:
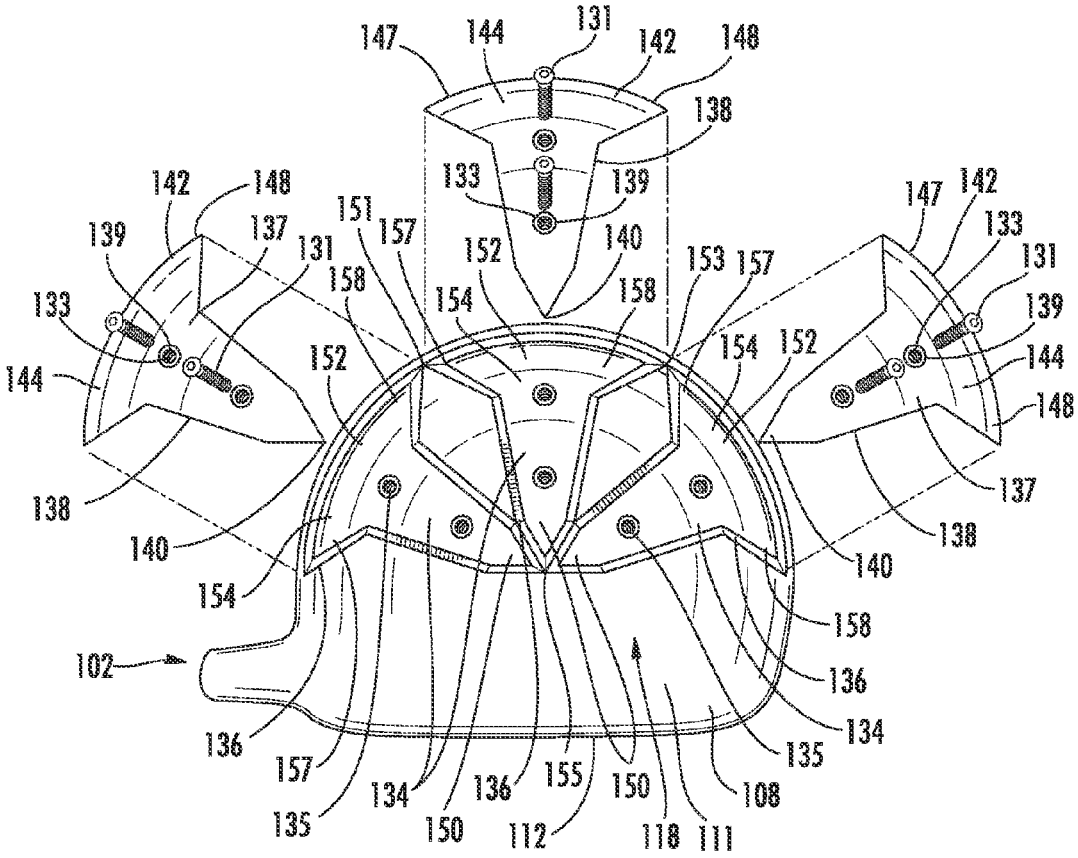
FIG. 2 is an exploded bottom view of the head of FIG. 1, showing the connection of a plurality of inserts to the head.
Figure 3:
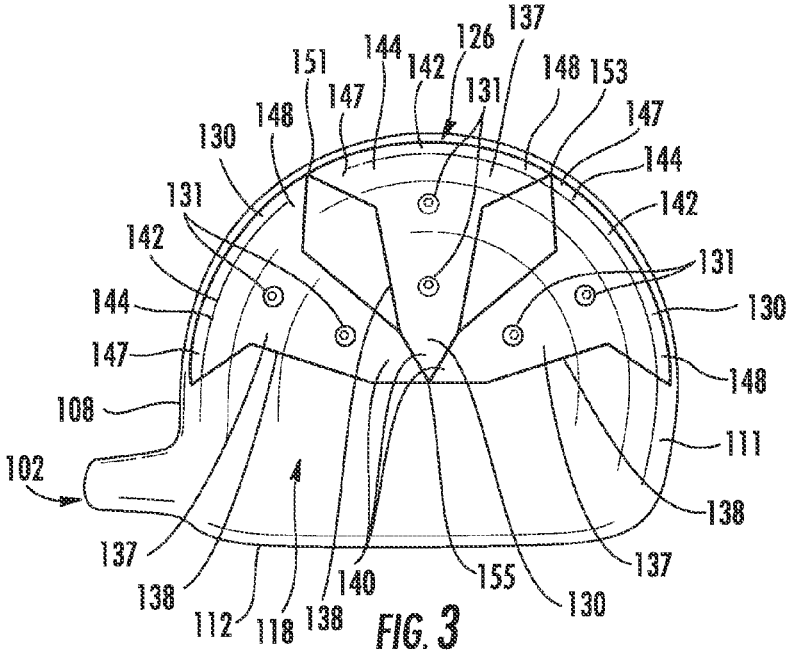
FIG. 3 is a bottom view of the head of FIG. 1, with the inserts connected to the head.

The golf club 100 shown in FIGS. 1-3 includes a ball striking head 102 configured to strike a ball in use and a shaft 104 connected to the ball striking head 102 and extending therefrom. The ball striking head 102 of the golf club 100 of FIG. 1 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top 116, a bottom or sole 118, a heel 120 proximate the hosel 109, a toe 122 distal from the hosel 109, a front 124, and a back or rear 126, as shown in FIGS. 1-5. The shape and design of the head 102 may be partially dictated by the intended use of the golf club 100. In the club 100 shown in FIGS. 1-3, the head 102 has an enclosed volume, as the club 100 is a wood-type golf club designed for use as a driver, intended to hit the ball long distances. In other applications, such as for a different type of golf club, the head 102 may be designed to have different dimensions and configurations. For example, when configured as a driver, as shown in FIGS. 1-3, the club head may have a volume of at least 400 cc, and in some structures, at least 450 cc, or even at least 460 cc. If instead configured as a fairway wood, the head 102 may have a volume of 120 cc to 230 cc, and if configured as a hybrid club, the head 102 may have a volume of 85 cc to 140 cc. Other appropriate sizes for other club heads may be readily determined by those skilled in the art.

Figure 22:
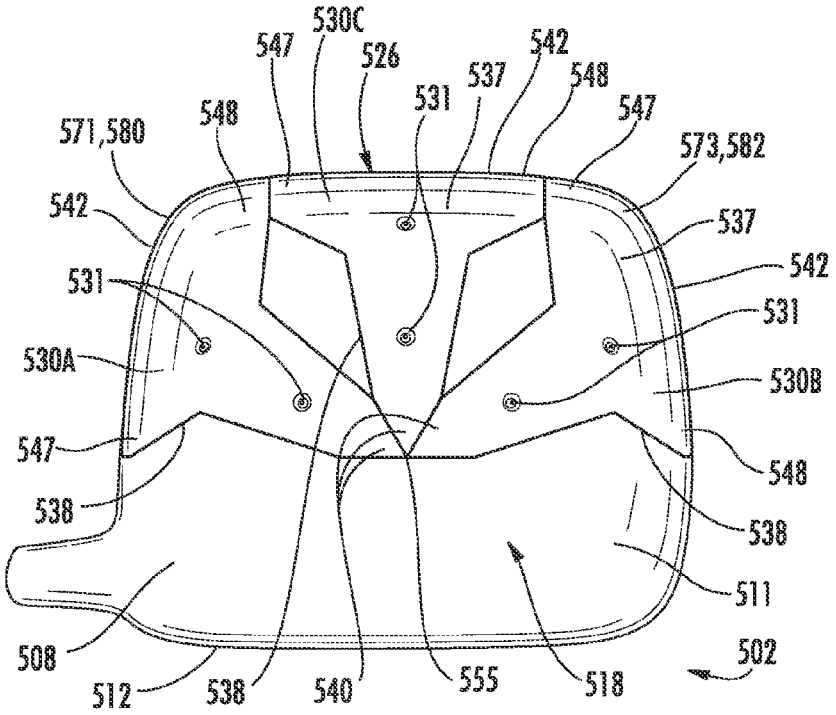
FIG. 22 is a bottom view of the head of FIG. 21, with the inserts connected to the head.

The body 108 of the head 102 can have various different shapes, including a rounded shape, as in the head 102 shown in FIGS. 1-3, a squared or rectangular shape, as in the head 502 shown in FIGS. 21-22, or other any of a variety of other shapes. It is understood that such shapes may be configured to distribute weight away from the face 112 and/or the geometric/volumetric center of the head 102, in order to create a lower center of gravity and/or a higher moment of inertia.

In the illustrative embodiment illustrated in FIGS. 1-3, the head 102 has a hollow structure defining an inner cavity (not shown) defined by the face 112 and the body 108 with a plurality of inner surfaces defined therein. In one embodiment, the inner cavity may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon and an inner surface (not shown) opposite the ball striking surface 110, as illustrated in FIGS. 1-3. The ball striking surface 110 is typically an outer surface of the face 112 configured to face a ball (not shown) in use, and is adapted to strike the ball when the golf club 100 is set in motion, such as by swinging. As shown, the ball striking surface 110 is relatively flat, occupying at least a majority of the face 112. The face 112 has a plurality of outer or peripheral edges, including a top edge 113 and a bottom edge 115. The edges of the face 112 may be defined as the boundaries of an area of the face 112 that is specifically designed to contact the ball in use, and may be recognized as the boundaries of an area of the face 112 that is intentionally flattened and smoothed to be suited for ball contact. For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-3, the ball striking surface 110 is inclined (i.e., at a loft angle), to give the ball 106 a desired lift and spin when struck. In other illustrative embodiments, the ball striking surface 110 may have a different incline or loft angle, to affect the trajectory of the ball 106. Additionally, the face 112 may have a variable thickness, and also may have one or more internal or external inserts in some embodiments.

It is understood that the face 112, the body 108, and/or the hosel 109 can be formed as a single piece or as separate pieces that are joined together. The face 112 may be formed as part of a face frame member with the body 108 being partially or wholly formed by one or more separate pieces connected to the face frame member, with a wall or walls extending rearward from the edges of the face 112. This configuration is also known as a "cup face" structure. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The golf club 100 may include a shaft 104 connected to or otherwise engaged with the ball striking head 102 as shown schematically in FIG. 1. The shaft 104 is adapted to be gripped by a user to swing the golf club 100 to strike the ball. The shaft 104 can be formed as a separate piece connected to the head 102, such as by connecting to the hosel 109, as described above and shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104. The grip element may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention have one or more removable inserts 130 connected to the outer surface 111 of the body 108. In the embodiments illustrated herein, the inserts 130 are thin plate members each having an inner surface 132, and the inserts 130 are configured to be connected to the body 108 in surface-to-surface contact, such that the inner surface 132 of each insert confronts the outer surface 111 of the body 108. Additionally, in the embodiments illustrated herein, the inserts 130 are configured for connection to the sole 118 of the head 102, but in other embodiments, one or more inserts may be configured for connection to other portions of the body 108. Various embodiments of heads 102, 502 having different types of inserts 130, 230, 250, 330, 350, 360, 430A-C, 530A-C are described below.

Figure 4:
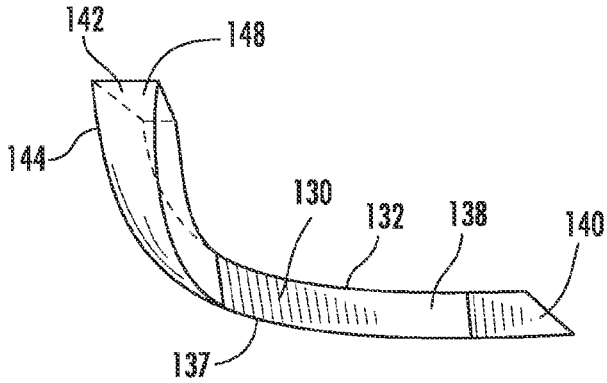
FIG. 4 is a side view of one of the plurality of inserts in FIGS. 1-3.
Figure 5:
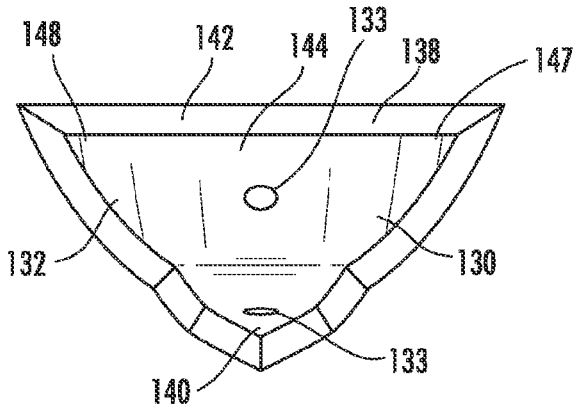
FIG. 5 is a rear view of the insert of FIG. 4.

FIGS. 1-3 illustrate one exemplary embodiment of a head 102 that includes three inserts 130 connected to the body 108 of the head 102. As shown in FIGS. 2-3, the outer surface 111 of the body 108 has a plurality of recesses 134, and the inserts 130 are configured to be connected to the body 108, such that the inserts 130 are at least partially received within the recesses 134. One of the inserts 130 in FIGS. 1-3 is shown in greater detail in FIGS. 4-5. As seen in FIGS. 4-5, the inner surface 132 of the insert 130 is contoured similarly to the outer surface 111 of the body 108 and is cooperatively dimensioned with the outer surface 111 of the body 108. Accordingly, when the inserts 130 are connected to the body, as shown in FIG. 3, the inner surface 132 of the insert 130 is positioned to confront the outer surface 111 of the body 108 in surface-to-surface arrangement. Additionally, the recesses 134 each have a chamfered edge 136 around the periphery of the recess 134. As seen in FIGS. 4-5, the inserts 130 each have a complementary chamfered edge 138 around the periphery of the insert 130. When each insert 130 is connected to the body 108, the chamfered edge 138 of the insert 130 confronts the chamfered edge 136 of the recess 134.

In the embodiment of FIGS. 1-5, the inserts 130 are connected and retained to the head 102 by fasteners 131 in the form of screws, bolts, or other threaded fasteners. Each insert 130 has two holes 133 extending through the insert 130 to receive the fasteners 131 therethrough, and the body 108 has threaded holes 135 positioned within the recesses 134 to receive the fasteners 131 in threading engagement to retain the fasteners 131 within the holes 133. Additionally, each insert 130 has a countersunk portion 139 around each of the holes 133 to receive the heads of the fasteners 131 therein, so that the fasteners 131 do not extend significantly above the outer surfaces 137 of the inserts 130. In other embodiments, the inserts 130 may be removably connected to the head 102 in a different manner, including by a different type of fastener or other removable connection, or may be non-removably connected to the head 102.

Each of the inserts 130 of the embodiment shown in FIGS. 1-5 has a width that tapers outwardly from a first end 140 to a second end 142. In this embodiment, the second end 142 of the insert 130 has a wide portion 144 and the edges 138 of the insert 130 taper to a point at the first end 140. The wide portion 144 has opposed first and second sides 147, 148 that define the widest point of the insert 130, and the edges of the wide portion taper to points at the first and second sides 147, 148. As shown in FIG. 2, the recesses 134 each have a similar shape to inner surfaces 132 of the inserts 130, each having a first end 150 located proximate the center of the sole 118 and a second end 152 located proximate the rear 126 of the head 102. The second end 152 of each recess 134 has a wide portion 154 and the edges 136 of the recess 134 taper to a point at the first end 150. The wide portion 154 has opposed first and second sides 157, 158 that define the widest point of the recess 134, and the edges of the wide portion taper to points at the first and second sides 157, 158.

In the embodiment shown in FIGS. 1-3, the recesses 134 are positioned in a radiating arrangement on the sole 118 of the body 108, such that the points at the first ends 150 of all of the recesses 134 converge to a single point 155 proximate the center of the sole 118. Additionally, the second ends 152 of the recesses 134 are positioned around the rear 126 of the head 102 such that the second end 152 of each recess 134 is positioned along the area of the head 102 having the largest (maximum) outer periphery. The middle recess 134 is positioned such that the point on the first side 157 of the wide portion 154 converges to a single point 151 with the point on the second side 158 of the adjacent recess 134 on the left in FIG. 2, and the point on the second side 158 of the wide portion 154 converges to a single point 153 with the point on the first side 157 of the adjacent recess 134 on the right in FIG. 2. In this embodiment, the inserts 130 are positioned in a similar manner to the recesses 134 when the inserts 130 are connected to the head 102. The inserts 130 are positioned in a radiating arrangement on the sole 118 of the body 108, such that the points at the first ends 140 of all of the inserts 130 converge to the single point 155 proximate the center of the sole 118. Additionally, the second ends 142 of the inserts 130 are positioned around the rear 126 of the head 102 such that the second end 142 of each insert is positioned along the area of the head 102 having the largest (maximum) outer periphery. The middle insert 130 is positioned such that the point on the first side 147 of the wide portion 144 converges to the single point 151 with the point on the second side 148 of the adjacent insert 130 on the left in FIG. 3, and the point on the second side 148 of the wide portion 144 converges to the single point 153 with the point on the first side 147 of the adjacent insert 130 on the right in FIG. 3.

In the embodiment illustrated in FIGS. 1-3, the inserts 130 are mounted within the recesses 134 such that the outer surfaces 137 of the inserts 130 are flush or substantially flush with the outer surface 111 of the body 108, and the heads of the fasteners 131 are either substantially flush with or recessed from the outer surfaces 137 of the inserts 130. This configuration can reduce or eliminate any potential for increased drag between the head 102 and the playing surface during a swing that may be caused by the presence of the inserts 130. It is understood that in other embodiments, the thickness of each insert 130 may be different, and the outer surfaces 137 of the inserts 130 may extend above, or be recessed from, the outer surface 111 of the body 108. Additionally, in one embodiment, the outer surfaces 137 of the inserts 130 are contoured similarly to the outer surface 111 of the body 108, providing aesthetic appeal and further reducing potential drag between the head 102 and the playing surface. As shown in the embodiment of FIG. 3, the second ends 142 of the inserts 130 each have a rounded outer contour to conform with the rounded outer contour of the rear 126 of the head 102. Further configurations are possible in other embodiments, including configurations in which part or all of the outer surfaces 137 of the inserts 130 are not flush with adjacent surfaces of the body 108. For example, in one embodiment, the inserts 130 may contain structures that can alter the appearance of the head 102, including structures to change the outer shape of the head 102, such as in the embodiment illustrated in FIGS. 16-20.

Each of the inserts 130 illustrated in FIGS. 1-5 is structurally similar or identical in size and/or shape to each of the other inserts 130, at least in part, to permit the inserts 130 to be interchanged with each other. In one embodiment, at least a portion of the inner surface 132 of each of the inserts 130 are structurally identical, to provide similar connecting structure for connection to the outer surface 111 of the body 108. The inserts 130 shown in FIGS. 1-5 each have chamfered edges 138 defining a boundary of a projecting portion 141 of the inner surface 132 that has the same shape as the recesses 134 and is configured to be received in one of the recesses 134. As shown in FIG. 5, the projecting portion 141 has substantially the same size and shape as the outer surface 137 of the insert 130 in this embodiment. However, in another embodiment, such as the embodiment shown in FIGS. 16-20, the insert 430A-C may have a projecting portion 441 that has a different size and/or shape from the outer surface 437 of the insert 430A-C. In some embodiments, the inserts 130 may contain similar inner structures, while the outer structures of the inserts 130 may be similar or different. As described in greater detail below, one or more additional inserts having similar or identical shapes can also be provided to be interchangeable with the inserts 130 shown in FIGS. 1-5.

In one embodiment, at least one of the inserts 130 has a different weight than at least one other insert 130. In the embodiment shown in FIGS. 1-5, the inserts 130 have the same size and shape, and the different weights of the inserts 130 can be created by using materials having different densities. For example, one of the inserts 130 may be made of titanium or steel, while another insert 130 may be made of aluminum or another lighter material. Further potential materials that may be used to construct the inserts 130 include polymers, composites, ceramics, and any other materials described above for use in construction of the head 102. In another example, all of the inserts 130 may be made from the same basic or bulk material, but one or more of the inserts 130 may have a different porosity level, a different level of inclusions (heavier or lighter particles distributed within the bulk material), different alloying additions, a hollow interior, a heavier or lighter secondary insert (as described below), or other variations that may alter the density of the insert 130. In a further example, one or more of the inserts 130 may have a different shape, altering the weight of the insert 130. As described in further detail below, the inserts 130 having different weights can be removed and interchanged to alter the weight distribution of the head 102.

Figure 6:
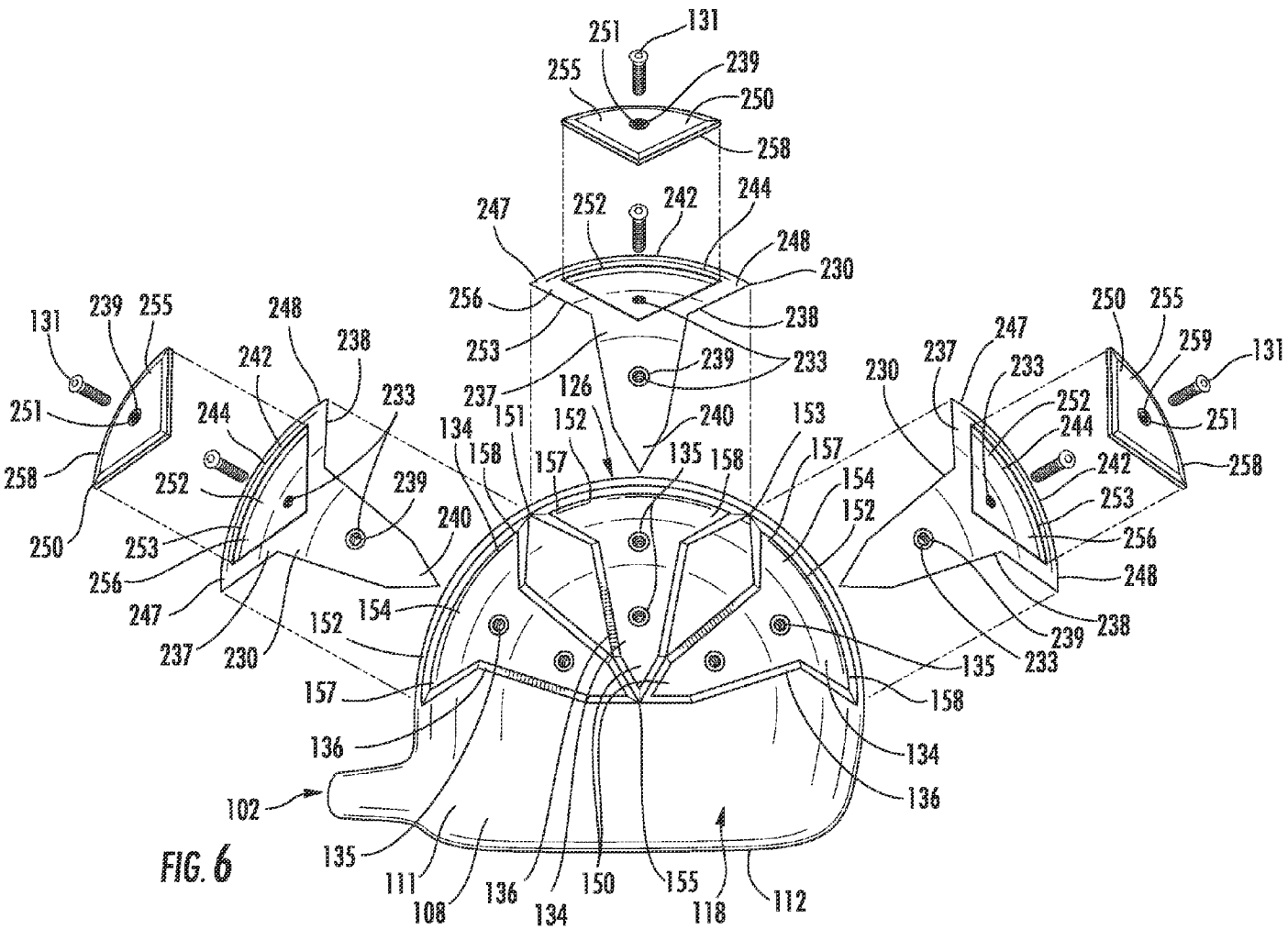
FIG. 6 is an exploded bottom view of a second illustrative embodiment of a head of a ball striking device according to the present invention, showing the connection of a plurality of primary inserts and secondary inserts to the head.
Figure 7:
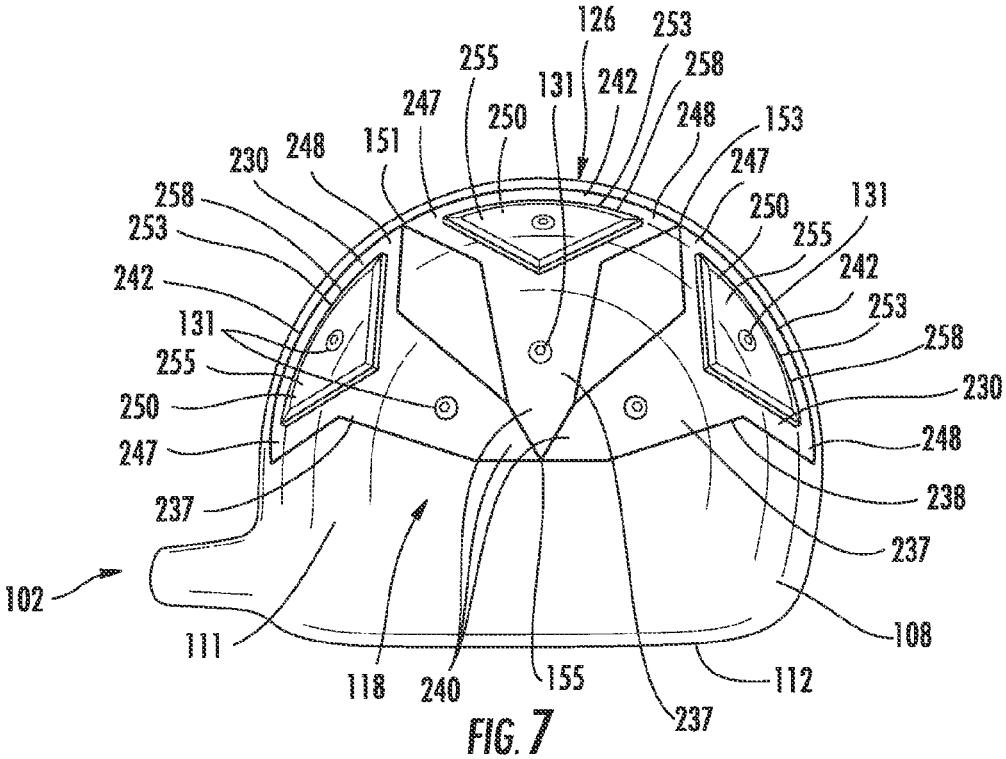
FIG. 7 is a bottom view of the head of FIG. 6, with the inserts connected to the head.

FIGS. 6-10 illustrate a second illustrative embodiment of a head 102 according to the present invention, having inserts 230, 250 connected to the body 108 of the head 102. The head 102 depicted in FIGS. 6-7 is similar or identical to the head 102 depicted in FIGS. 1-3, having a body 108 with recesses 134 on the outer surface 111 that are similar or identical to the recesses 134 described above and shown in FIGS. 1-3. In this embodiment, the head 102 has both primary inserts 230 and secondary inserts 250 connected thereto, unlike the head 102 shown in FIGS. 1-5.

Figure 8:
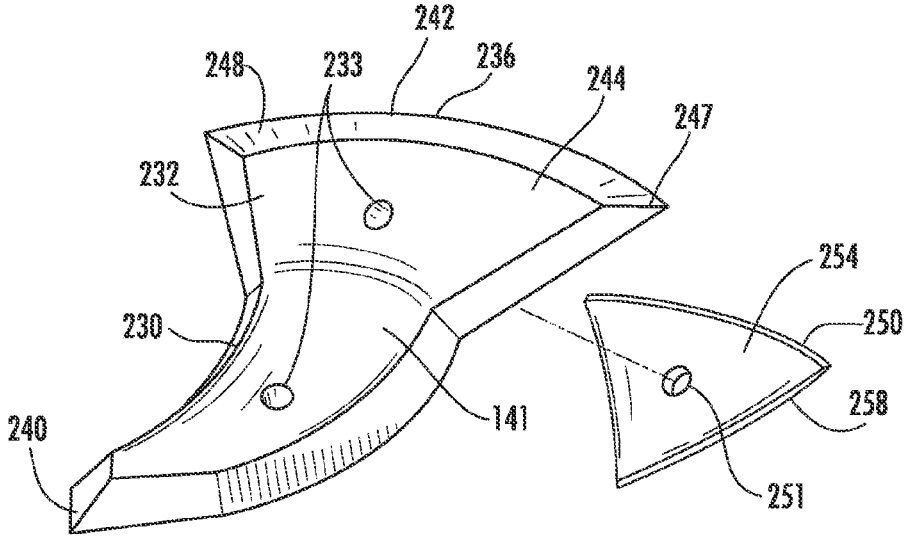
FIG. 8 is an exploded rear perspective view of one of the primary inserts and one of the secondary inserts in FIG. 6.
Figure 9:
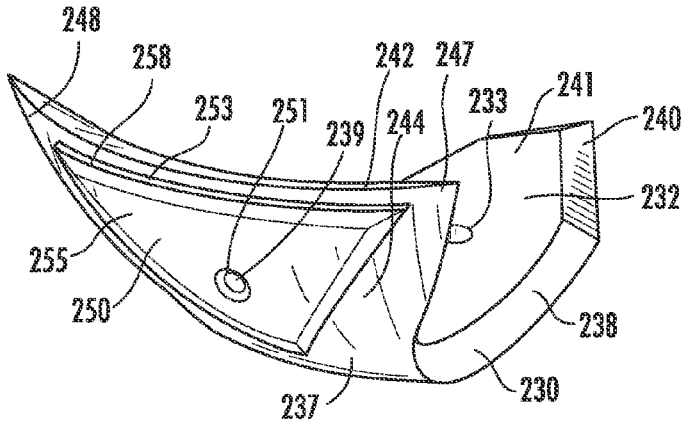
FIG. 9 is a perspective view of the inserts of FIG. 8, with the inserts connected together.
Figure 10:
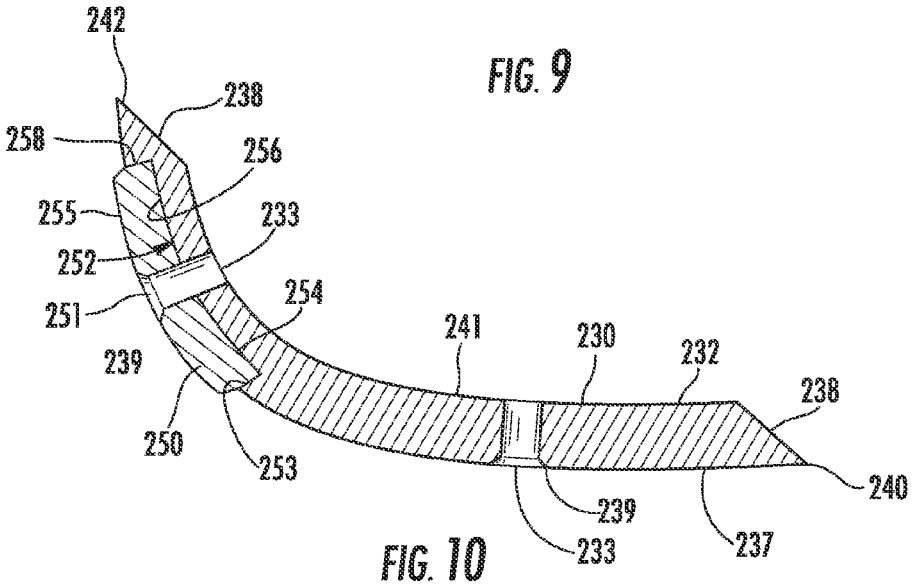
FIG. 10 is a cross-sectional view of the inserts of FIG. 9.
Figure 77:
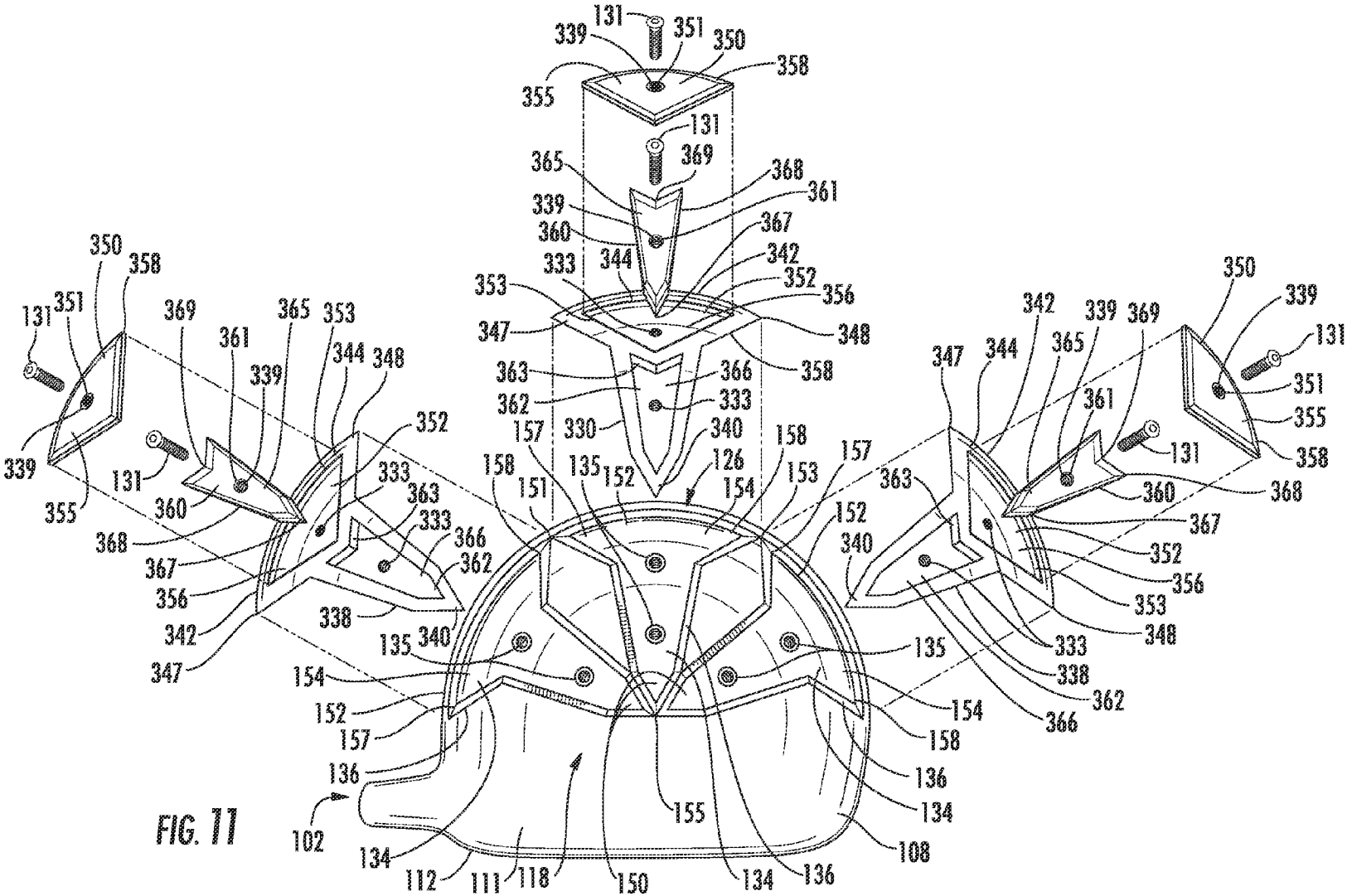

The inserts 230, 250 in FIGS. 6-7 are shown in greater detail in FIGS. 8-10. The primary inserts 230 in this embodiment are thin plate members that are similar in some respects to the inserts 130 in FIGS. 1-5. As seen in FIGS. 8-10, the inner surface 232 of the primary insert 230 is contoured similarly to the outer surface 111 of the body 108 and is cooperatively dimensioned with the outer surface 111 of the body 108. Accordingly, when the primary inserts 230 are connected to the body, as shown in FIG. 7, the inner surface 232 of each primary insert 230 is positioned to confront the outer surface 111 of the body 108 in surface-to-surface arrangement. As seen in FIGS. 8-10, the primary inserts 230 each have a chamfered edge 238 around the periphery of the insert 230 that is complementary to the chamfered edge 136 around the periphery of the recess 134 on the body 108. In this respect, the primary inserts 230 in this embodiment are similar in size and shape to the inserts 130 in FIGS. 1-5. When each primary insert 230 is connected to the body 108, the chamfered edge 238 of the insert 230 confronts the chamfered edge 136 of the recess 134.

Each of the primary inserts 230 of the embodiment shown in FIGS. 6-10 has a width that tapers outwardly from a first end 240 to a second end 242. In this embodiment, the second end 242 of the primary insert 230 has a wide portion 244 and the edges 238 of the primary insert 230 taper to a point at the first end 240. The wide portion 244 has opposed first and second sides 247, 248 that define the widest point of the primary insert 230, and the edges of the wide portion 244 taper to points at the first and second sides 247, 248. As described above, the recesses 134 each have a similar shape to inner surfaces 132 of the inserts 130.

The primary inserts 230 in the embodiment of FIGS. 6-10 each are configured to have a secondary insert 250 connected thereto. In this embodiment, each of the primary inserts 230 contains a cavity 252 on the outer surface 237 of the primary insert 230 that is configured to receive one of the secondary inserts 250 therein. As shown in FIGS. 6-10, the secondary inserts 250 each have a substantially smooth inner surface 254 that confronts the outer surface 237 of the primary insert 230 at the substantially smooth bottom surface 256 of the cavity 252 when the secondary insert 250 is inserted into the cavity 252. Additionally, the secondary inserts 250 each have a substantially smooth outer surface 255 that projects beyond the outer surface 237 of the primary insert 230 when the secondary insert 250 is received in the cavity 252. In this embodiment, the secondary inserts 250 also each have an outer edge 258 defining a generally triangular shape. The outer edges 258 of the secondary inserts 250 shown in FIGS. 6-10 are beveled near the outer surface 255.

The cavity 252 is shaped similarly to the secondary insert 250 to restrict the movement of the secondary insert 250 within the cavity 252, and the outer edge 258 of the secondary insert 250 engages the inner edge 253 of the cavity 252. In other embodiments, the secondary insert 250 and/or the cavity 252 may have a different shape or surface configuration. For example, the secondary insert may be circular, rectangular, or another shape, including polygonal shapes, curvilinear shapes, etc., or the secondary insert 250 may have an inner surface 254 and/or outer surface 255 that are differently shaped or contoured. The shape and configuration of the recess 252 may be similarly varied. As another example, in one embodiment, the secondary insert 250 and the cavity 252 may have complementary chamfered edges, similar to the primary insert 230 and the recess 134. As a further example, the primary insert 230 may not have a cavity 252 for the secondary insert 252, and the secondary insert 252 may be configured for connection to the primary insert 230 in a different manner. As an additional example, the secondary insert 250 may have a larger or smaller thickness, and the outer surface 255 of the secondary insert 250 may be substantially flush with the edges 253 of the cavity 252 and the adjacent portions of the outer surface 237 of the primary insert 230 when the secondary insert 250 is received in the cavity. As a further example, the primary insert 230 and the secondary insert 250 may have additional complementary or interlocking structures.

In the embodiment of FIGS. 6-10, the primary inserts 230 and the secondary inserts 250 are connected and retained to the head 102 by fasteners 131, as similarly described above. Each primary insert 230 has two holes 233 extending through the insert 230 to receive the fasteners 131 therethrough, and the body 108 has threaded holes 135 positioned within the recesses 134 to receive the fasteners 131 in threading engagement to retain the fasteners 131 within the holes 133. Each secondary insert 250 also has a hole 251 extending through the insert 250 to receive one of the fasteners 131 therethrough. One of the holes 233 in the primary insert 230 is positioned within the cavity 252, so that when the secondary insert 250 is received in the cavity 252, the hole 251 of the secondary insert 250 is aligned with the hole 233 of the primary insert 230, as shown in FIG. 10, allowing a single fastener 131 to extend through both holes 233, 251 to connect both the primary insert 230 and the secondary insert 252 to the body 108. Additionally, one of the holes 233 on the primary insert 230 and the hole 251 of the secondary insert 250 each have a countersunk portion 239 around each hole 233, 251 to receive the heads of the fasteners 131 therein, so that the fasteners 131 do not extend significantly above the outer surfaces 237, 255 of the inserts 230, 250. In other embodiments, the primary and secondary inserts 230, 250 may be removably connected to the head 102 in a different manner, including by a different type of fastener or other removable connection, or may be non-removably connected to the head 102 and/or to each other.

The body 108 and the recesses 134 in the embodiment shown in FIGS. 6-7 are configured similarly to the components described above and shown in FIGS. 1-3. Additionally, in this embodiment, the primary inserts 230 are positioned in a similar manner to the inserts 130 described above with respect to FIGS. 1-5. The primary inserts 230 are positioned in a radiating arrangement on the sole 118 of the body 108, such that the points at the first ends 240 of all of the primary inserts 230 converge to the single point 155 proximate the center of the sole 118. Additionally, the second ends 242 of the primary inserts 230 are positioned around the rear 126 of the head 102 such that the second end 242 of each insert 230 is positioned along the area of the head 102 having the largest (maximum) outer periphery. The middle insert 230 is positioned such that the point on the first side 247 of the wide portion 244 converges to the single point 151 with the point on the second side 248 of the adjacent insert 230 on the left in FIG. 7, and the point on the second side 248 of the wide portion 244 converges to the single point 153 with the point on the first side 247 of the adjacent insert 230 on the right in FIG. 7.

In the embodiment illustrated in FIGS. 6-10, the primary inserts 230 are mounted within the recesses 134 such that the outer surfaces 237 of the primary inserts 230 are flush or substantially flush with the outer surface 111 of the body 108, and the heads of the fasteners 131 are either substantially flush with or recessed from the outer surfaces 237 of the primary and secondary inserts 230, 250. As stated above, the secondary inserts 250 may extend slightly above the outer surfaces 237 of the primary inserts 230. Additionally, in one embodiment, the outer surfaces 237 of the primary inserts 230 are contoured similarly to the outer surface 111 of the body 108, similarly to the inserts 130 described above with respect to FIGS. 1-5. As shown in the embodiment of FIG. 7, the second ends 242 of the primary inserts 230 each have a rounded outer contour to conform with the rounded outer contour of the rear 126 of the head 102.

Each of the primary inserts 230 illustrated in FIGS. 6-10 is structurally similar or identical in size and/or shape to each of the other primary inserts 230, at least in part, to permit the primary inserts 230 to be interchanged with each other. In one embodiment, at least a portion of the inner surfaces 232 of each of the primary inserts 230 are structurally identical, to provide similar connecting structure for connection to the outer surface 111 of the body 108. The primary inserts 230 shown in FIGS. 6-10 each have chamfered edges 238 defining a boundary of a projecting portion 241 of the inner surface 232 that has the same shape as the recesses 134 and is configured to be received in one of the recesses 134, similarly to the inserts 130 described above and shown in FIGS. 1-5. Additionally, the secondary inserts 250 in FIGS. 6-10 are all structurally similar or identical in size and/or shape to each other, at least in part, to permit the secondary inserts 250 to be interchanged with each other. In one embodiment, at least a portion of the inner surfaces 254 of each of the secondary inserts 250 are structurally identical, to provide similar connecting structure. Likewise, the cavities 252 in the primary inserts 230 are structurally similar or identical, to permit the secondary inserts 250 to be interchanged. In some embodiments, the inserts 130 may contain similar inner structures, while the outer structures of the inserts 130 may be similar or different. As described in greater detail below, one or more additional primary and/or secondary inserts having similar or identical shapes can also be provided to be interchangeable with the inserts 230, 250 shown in FIGS. 6-10. In another embodiment, two or more secondary inserts 250 may be connected to the primary insert 230 within the same cavity 252, or one or more of the secondary inserts 250 may be connected to the primary insert 230 in another manner.

In one embodiment, at least one of the primary inserts 230 has a different weight than at least one other primary insert 230, and at least one of the secondary inserts 250 has a different weight than at least one other secondary insert 250. In the embodiment shown in FIGS. 6-10, the inserts 230, 250 have the same size and shape, and the different weights of the inserts 230, 250 can be created by using materials having different densities, as described above with respect to the inserts 130 in FIGS. 1-5. As also described above, one or more of the inserts 230, 250 may have a different shape, altering the weight of the insert 230, 250. As described in further detail below, the inserts 230, 250 having different weights can be removed and interchanged to alter the weight distribution of the head 102.

Figure 12:
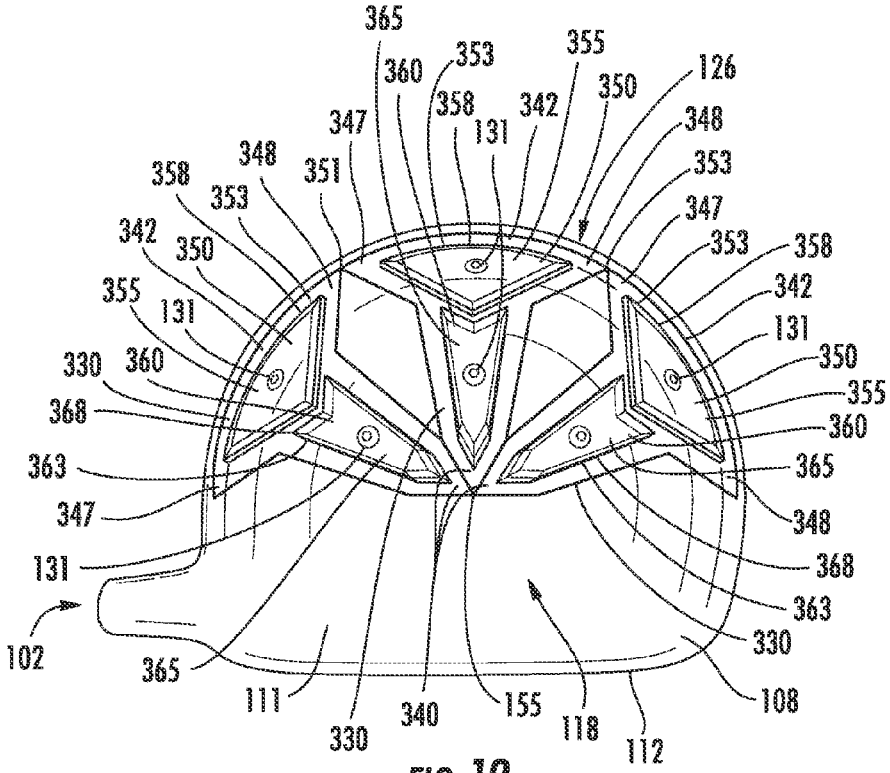
FIG. 12 is a bottom view of the head of FIG. 11, with the inserts connected to the head.

FIGS. 11-15 illustrate a third illustrative embodiment of a head 102 according to the present invention, having inserts 330, 350, 360 connected to the body 108 of the head 102. The head 102 depicted in FIGS. 11-12 is similar or identical to the head 102 depicted in FIGS. 1-3, having a body 108 with recesses 134 on the outer surface 111 that are similar or identical to the recesses 134 described above and shown in FIGS. 1-3. In this embodiment, the head 102 has primary inserts 330 and secondary inserts 350, 360 connected thereto, unlike the head 102 shown in FIGS. 1-5.

Figure 13:
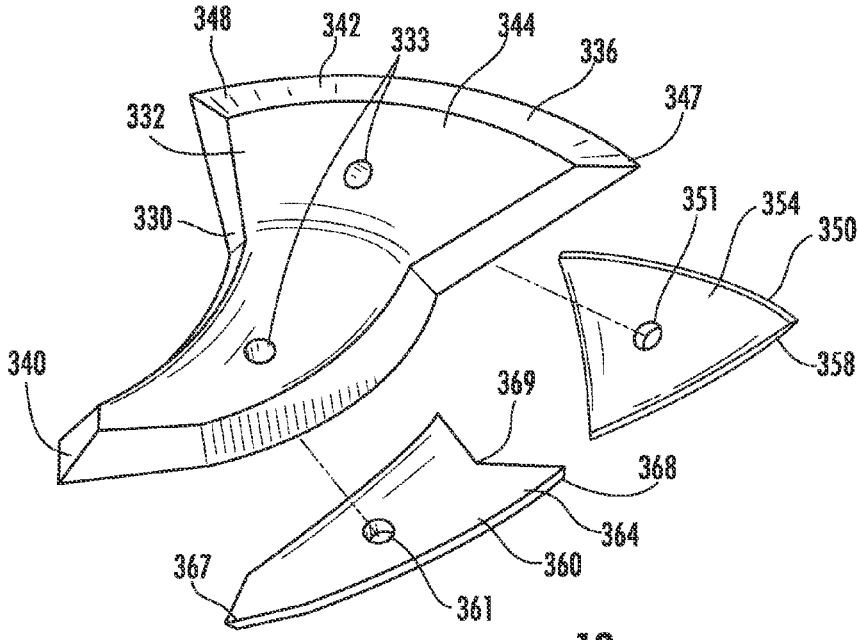
FIG. 13 is an exploded rear perspective view of one of the primary inserts and two of the secondary inserts in FIG. 11.
Figure 14:
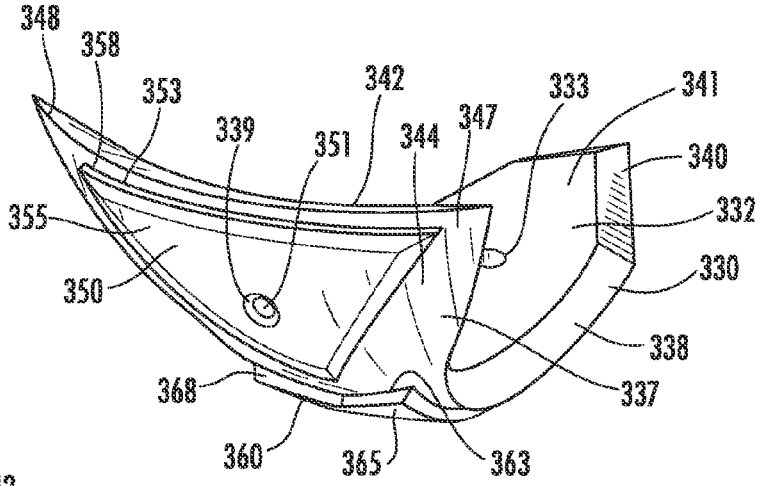
FIG. 14 is a perspective view of the inserts of FIG. 13, with the inserts connected together.
Figure 15:
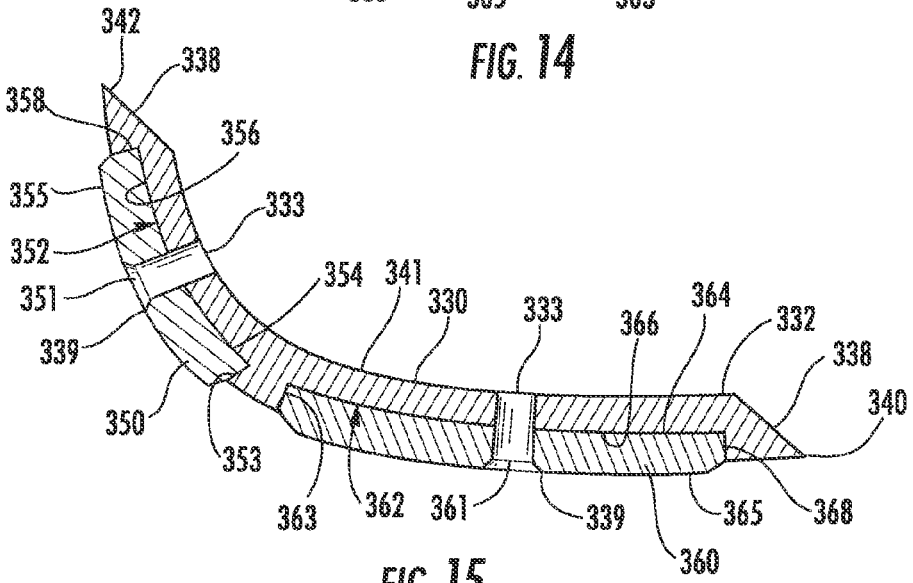
FIG. 15 is a cross-sectional view of the inserts of FIG. 14.

The inserts 330, 350, 360 in FIGS. 11-12 are shown in greater detail in FIGS. 13-15. The primary inserts 330 in this embodiment are thin plate members that are similar in some respects to the inserts 130 in FIGS. 1-5. As seen in FIGS. 13-15, the inner surface 332 of the primary insert 330 is contoured similarly to the outer surface 111 of the body 108 and is cooperatively dimensioned with the outer surface 111 of the body 108. Accordingly, when the primary inserts 330 are connected to the body, as shown in FIG. 12, the inner surface 332 of each primary insert 330 is positioned to confront the outer surface 111 of the body 108 in surface-to-surface arrangement. As seen in FIGS. 13-15, the primary inserts 330 each have a chamfered edge 338 around the periphery of the insert 330 that is complementary to the chamfered edge 136 around the periphery of the recess 134 on the body 108. In this respect, the primary inserts 330 in this embodiment are similar in size and shape to the inserts 130 in FIGS. 1-5. When each primary insert 330 is connected to the body 108, the chamfered edge 338 of the insert 330 confronts the chamfered edge 136 of the recess 134.

Each of the primary inserts 330 of the embodiment shown in FIGS. 11-15 has a width that tapers outwardly from a first end 340 to a second end 342. In this embodiment, the second end 342 of the primary insert 330 has a wide portion 344 and the edges 338 of the primary insert 330 taper to a point at the first end 340. The wide portion 344 has opposed first and second sides 347, 348 that define the widest point of the primary insert 330, and the edges of the wide portion 344 taper to points at the first and second sides 347, 348. As described above, the recesses 134 each have a similar shape to inner surfaces 132 of the inserts 130.

The primary inserts 330 in the embodiment of FIGS. 11-15 each are configured to have a plurality of secondary inserts 350, 360 connected thereto. In this embodiment, each of the primary inserts 330 contains a first cavity 352 on the outer surface 337 of the primary insert 330 that is configured to receive a first type of secondary insert 350 therein, and a second cavity 362 on the outer surface 337 that is configured to receive a second type of secondary insert 360 therein. As shown in FIGS. 11-15, the secondary inserts 350, 360 each have a substantially smooth inner surface 354, 364 that confronts the outer surface 337 of the primary insert 330 at the substantially smooth bottom surfaces 356, 366 of the cavities 352, 362 when the secondary inserts 350, 360 are inserted into the cavities 352, 362. Additionally, the secondary inserts 350, 360 each have a substantially smooth outer surface 355, 365 that projects beyond the outer surface 337 of the primary insert 330 when the secondary inserts 350, 360 are received in the cavities 352, 362. In this embodiment, the secondary inserts 350, 360 also each have an outer edge 358, 368 defining the shapes thereof. The first type of secondary inserts 350 have a generally triangular shape, and the second type of secondary inserts 360 have an arrowhead-like shape, with a convex point 367 at one end and a concave point 369 at the opposite end. The outer edges 358, 368 of the secondary inserts 350, 360 shown in FIGS. 11-15 are beveled near the outer surfaces 355, 365 of the inserts 350, 360.

The cavities 352, 362 are shaped similarly to the secondary inserts 350, 360 to restrict the movement of the secondary inserts 350, 360 within the cavities 352, 362, and the outer edges 358, 368 of the secondary inserts 350, 360 engage the inner edges 353, 363 of the cavities 352, 362. In other embodiments, the secondary insert 250 and/or the cavity 252 may have a different shape or surface configuration. For example, the secondary inserts 350, 360 may be circular, rectangular, or another shape, including polygonal shapes, curvilinear shapes, etc., or the secondary inserts 350, 360 may have an inner surface 354, 364 and/or outer surface 355, 365 that are differently shaped or contoured. The shape and configuration of the recesses 352, 362 may be similarly varied. As another example, in one embodiment, the secondary inserts 350, 360 and the cavities 352, 362 may have complementary chamfered edges, similar to the primary insert 330 and the recess 134. As a further example, the primary insert 330 may not have a cavities 352, 362 for the first type of secondary insert 352 and/or the second type of secondary insert 362, and the secondary inserts 352, 362 may be configured for connection to the primary insert 330 in a different manner. As an additional example, the secondary inserts 350, 360 may have a larger or smaller thickness, and the outer surfaces 355, 365 of the secondary inserts 350, 360 may be substantially flush with the edges 353, 363 of the cavities 352, 362 and the adjacent portions of the outer surface 337 of the primary insert 330 when the secondary inserts 350, 360 are received in the cavities 352, 362. As a further example, the primary insert 330 and one or more of the secondary inserts 350, 360 may have additional complementary or interlocking structures.

In the embodiment of FIGS. 11-15, the primary inserts 330 and the secondary inserts 350, 360 are connected and retained to the head 102 by fasteners 131, as similarly described above. Each primary insert 330 has two holes 333 extending through the insert 330 to receive the fasteners 131 therethrough, and the body 108 has threaded holes 135 positioned within the recesses 134 to receive the fasteners 131 in threading engagement to retain the fasteners 131 within the holes 133. The first-type secondary inserts 350 each have a hole 351 extending through the insert 350 to receive one of the fasteners 131 therethrough, and the second-type secondary inserts 360 also each have a hole 361 extending through the insert 360 to receive the other fastener 131 therethrough. One of the holes 333 in the primary insert 330 is positioned within the first cavity 352, so that when the first-type secondary inserts 350 are received in the first cavities 352, the holes 351 of the first-type secondary inserts 350 are aligned with the holes 333 of the primary insert 330, as shown in FIG. 15, allowing a single fastener 131 to extend through both holes 333, 351 to connect both the primary insert 330 and the first-type secondary insert 350 to the body 108. Similarly, the other hole 333 in the primary insert 330 is positioned within the second cavity 362, so that when the second-type secondary inserts 360 are received in the second cavities 362, the holes 361 of the second-type secondary inserts 360 are aligned with the holes 333 of the primary insert 330, as also shown in FIG. 15, allowing a single fastener 131 to extend through both holes 333, 361 to connect both the primary insert 330 and the second-type secondary insert 360 to the body 108. Additionally, the holes 351, 361 on the secondary inserts 350, 360 each have a countersunk portion 339 around the respective holes 351, 361 to receive the heads of the fasteners 131 therein, so that the fasteners 131 do not extend significantly above the outer surfaces 355, 365 of the secondary inserts 350, 360. In other embodiments, the primary and secondary inserts 330, 350, 360 may be removably connected to the head 102 in a different manner, including by a different type of fastener or other removable connection, or may be non-removably connected to the head 102 and/or to each other.

The body 108 and the recesses 134 in the embodiment shown in FIGS. 11-12 are configured similarly to the components described above and shown in FIGS. 1-3. Additionally, in this embodiment, the primary inserts 330 are positioned in a similar manner to the inserts 130 described above with respect to FIGS. 1-5. The primary inserts 330 are positioned in a radiating arrangement on the sole 118 of the body 108, such that the points at the first ends 340 of all of the primary inserts 330 converge to the single point 155 proximate the center of the sole 118. Additionally, the second ends 342 of the primary inserts 330 are positioned around the rear 126 of the head 102 such that the second end 342 of each insert 330 is positioned along the area of the head 102 having the largest (maximum) outer periphery. The middle insert 330 is positioned such that the point on the first side 347 of the wide portion 344 converges to the single point 151 with the point on the second side 348 of the adjacent insert 330 on the left in FIG. 12, and the point on the second side 348 of the wide portion 344 converges to the single point 153 with the point on the first side 347 of the adjacent insert 330 on the right in FIG. 12.

In the embodiment illustrated in FIGS. 11-15, the primary inserts 330 are mounted within the recesses 134 such that the outer surfaces 337 of the primary inserts 330 are flush or substantially flush with the outer surface 111 of the body 108, and the heads of the fasteners 131 are either substantially flush with or recessed from the outer surfaces 355, 365 of the secondary inserts 350, 360. As stated above, the secondary inserts 350, 360 may extend slightly above the outer surfaces 337 of the primary inserts 330. Additionally, in one embodiment, the outer surfaces 337 of the primary inserts 330 are contoured similarly to the outer surface 111 of the body 108, similarly to the inserts 130 described above with respect to FIGS. 1-5. As shown in the embodiment of FIG. 12, the second ends 342 of the primary inserts 330 each have a rounded outer contour to conform with the rounded outer contour of the rear 126 of the head 102.

Each of the primary inserts 330 illustrated in FIGS. 11-15 is structurally similar or identical in size and/or shape to each of the other primary inserts 330, at least in part, to permit the primary inserts 330 to be interchanged with each other. In one embodiment, at least a portion of the inner surfaces 332 of each of the primary inserts 330 are structurally identical, to provide similar connecting structure for connection to the outer surface 111 of the body 108. The primary inserts 330 shown in FIGS. 11-15 each have chamfered edges 338 defining a boundary of a projecting portion 341 of the inner surface 332 that has the same shape as the recesses 134 and is configured to be received in one of the recesses 134, similarly to the inserts 130 described above and shown in FIGS. 1-5. Additionally, the first-type secondary inserts 350 in FIGS. 11-15 are all structurally similar or identical in size and/or shape to each other, at least in part, to permit the first-type secondary inserts 350 to be interchanged with each other. Likewise, the second-type secondary inserts 360 in FIGS. 11-15 are all structurally similar or identical in size and/or shape to each other, at least in part, to permit the second-type secondary inserts 360 to be interchanged with each other. In one embodiment, at least a portion of the inner surfaces 354 of each of the first-type secondary inserts 350 are structurally identical, and at least a portion of the inner surfaces 364 of each of the second-type secondary inserts 360 are structurally identical, to provide similar connecting structure. Likewise, the first cavities 352 in the primary inserts 330 are structurally similar or identical to each other, and the second cavities 362 are also structurally similar or identical to each other, to permit the secondary inserts 350, 360 to be interchanged. In some embodiments, the inserts 130 may contain similar inner structures, while the outer structures of the inserts 130 may be similar or different. As described in greater detail below, one or more additional primary and/or secondary inserts having similar or identical shapes can also be provided to be interchangeable with the inserts 330, 350, 360 shown in FIGS. 11-15. In another embodiment, two or more secondary inserts 350, 360 may be connected to the primary insert 330 within the same cavity 352, 362, or one or more of the secondary inserts 350, 360 may be connected to the primary insert 330 in another manner.

In one embodiment, at least one of the primary inserts 330 has a different weight than at least one other primary insert 330, at least one of the first-type secondary inserts 350 has a different weight than at least one other first-type secondary insert 350, and/or at least one of the second-type secondary inserts 360 has a different weight than at least one other second-type secondary insert 360. In the embodiment shown in FIGS. 11-15, the inserts 330, 350, 360 of the same type have the same size and shape, and the different weights of the inserts 330, 350, 360 can be created by using materials having different densities, as described above with respect to the inserts 130 in FIGS. 1-5. As also described above, one or more of the inserts 330, 350, 360 may have a different shape, altering the weight of the insert 330, 350, 360. As described in further detail below, the inserts 330, 350, 360 having different weights can be removed and interchanged to alter the weight distribution of the head 102.

Figure 16:
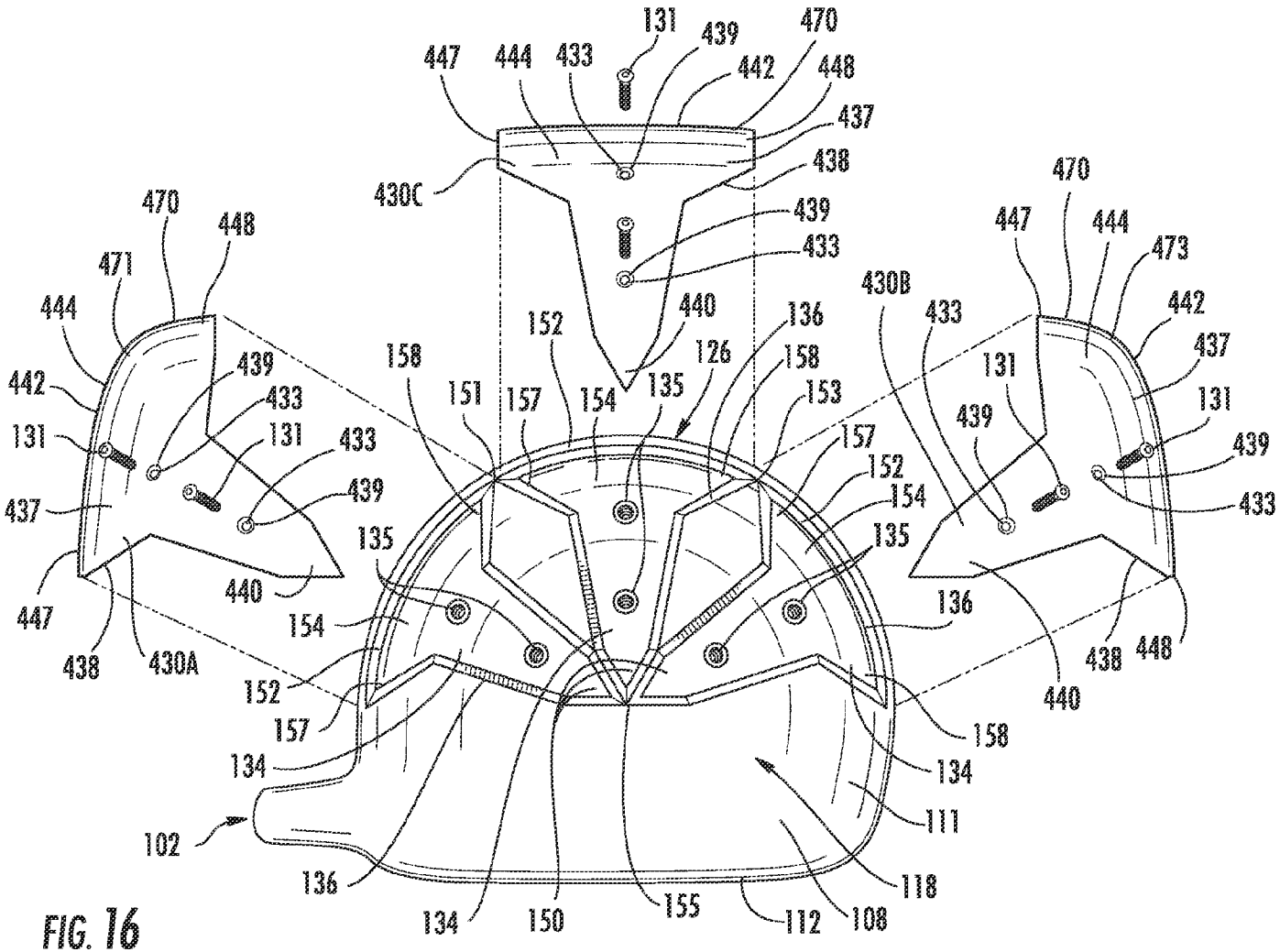
FIG. 16 is an exploded bottom view of a fourth illustrative embodiment of a head of a ball striking device according to the present invention, showing the connection of a plurality of inserts to the head.

FIGS. 16-20 illustrate a fourth illustrative embodiment of a head 102 according to the present invention, having inserts 430A-C connected to the body 108 of the head 102. The head 102 depicted in FIGS. 16-19 is similar or identical to the head 102 depicted in FIGS. 1-3, having a body 108 with recesses 134 on the outer surface 111 that are similar or identical to the recesses 134 described above and shown in FIGS. 1-3. In this embodiment, the head 102 has inserts 430A-C connected thereto that can change the shape of the rear periphery of the head 102, unlike the inserts 130 shown in FIGS. 1-5, which generally conform to the shape of the head 102. As shown in FIG. 16, the body 108 of the head 102 has a rounded profile on the rear 126 of the head 102. The inserts 430A-C are structured and contoured to give the head a generally rectangular rear profile, as described below.

In the embodiment of in FIGS. 16-19, the head 102 has three different inserts 430A-C connected thereto, and each of the inserts 430A-C is configured to be positioned in a specific position on the body 108. More specifically, the head 102 in FIGS. 16-19 has a left insert 430A connected to the body 108 on the left side of the body 108 as viewed in FIG. 17, a right insert 430B connected to the body 108 on the right side, and a middle insert 430C positioned between the left and right inserts 430A-B. Each of the inserts 430A-C in this embodiment has a thin plate member that makes up at least a portion of the insert 430A-C. The middle insert 430C in FIGS. 16-19 is shown in greater detail in FIG. 20. As seen in FIG. 20, the inner surface 432 of the middle insert 430C is contoured similarly to the outer surface 111 of the body 108 and is cooperatively dimensioned with the outer surface 111 of the body 108. Accordingly, when the middle insert 430C is connected to the body, as shown in FIG. 20, the inner surface 432 of the insert 430A is positioned to confront the outer surface 111 of the body 108 in surface-to-surface arrangement. The left and right inserts 430A-B are similarly configured, such that each of the left and right inserts 430A-B have the inner surface (not shown) positioned to confront the outer surface 111 of the body 108 in surface-to-surface arrangement.

As seen in FIG. 20, the middle insert 430C has a projecting portion 441 that is shaped similarly to the recess 134 on the body 108. The projecting portion 441 has a chamfered edge 438 around the periphery of the projecting portion 441 that is complementary to the chamfered edge 136 around the periphery of the recess 134 on the body 108. When the middle insert 430B is connected to the body 108, the chamfered edge 438 of the insert 430B confronts the chamfered edge 136 of the recess 134. The inner surfaces of the left and right inserts 430A-B are not shown in the FIGS., however, each of the left and right inserts 430A-B has a projecting portion (not shown) that is similar or identical to the projecting portion 441 of the middle insert 430C shown in FIG. 20. As such, the projecting portions 441 of the left and right inserts 430A-B are configured to confront the chamfered edges 136 of the recesses 134 on the left and right sides of the body 108 when the inserts 430A-B are connected to the head 102.

Figure 17:
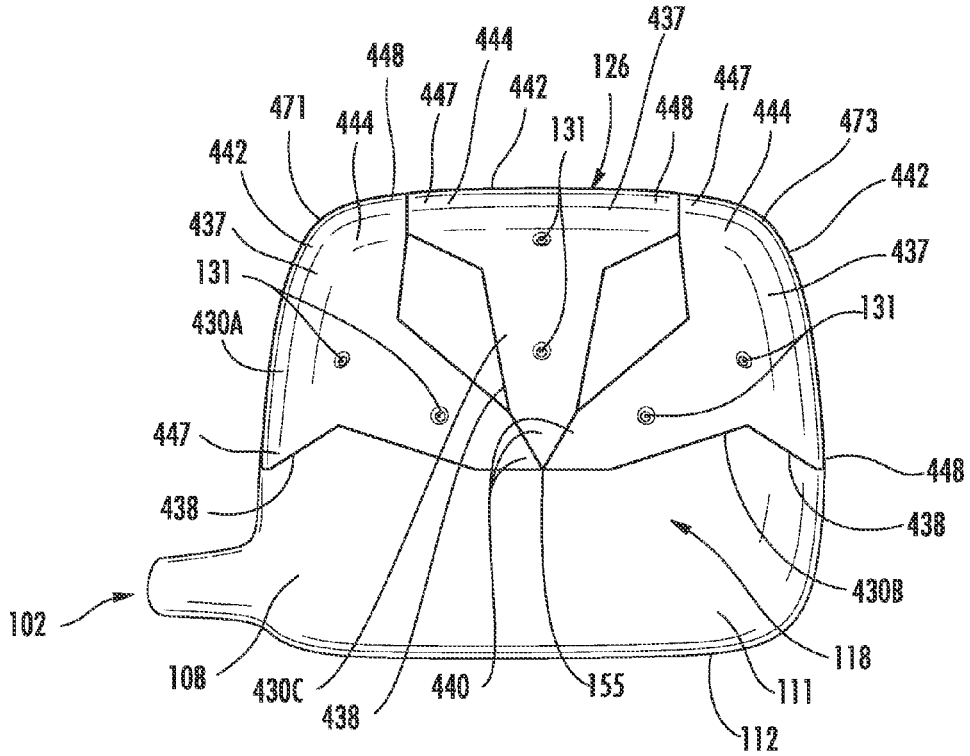
FIG. 17 is a bottom view of the head of FIG. 16, with the inserts connected to the head.
Figure 18:
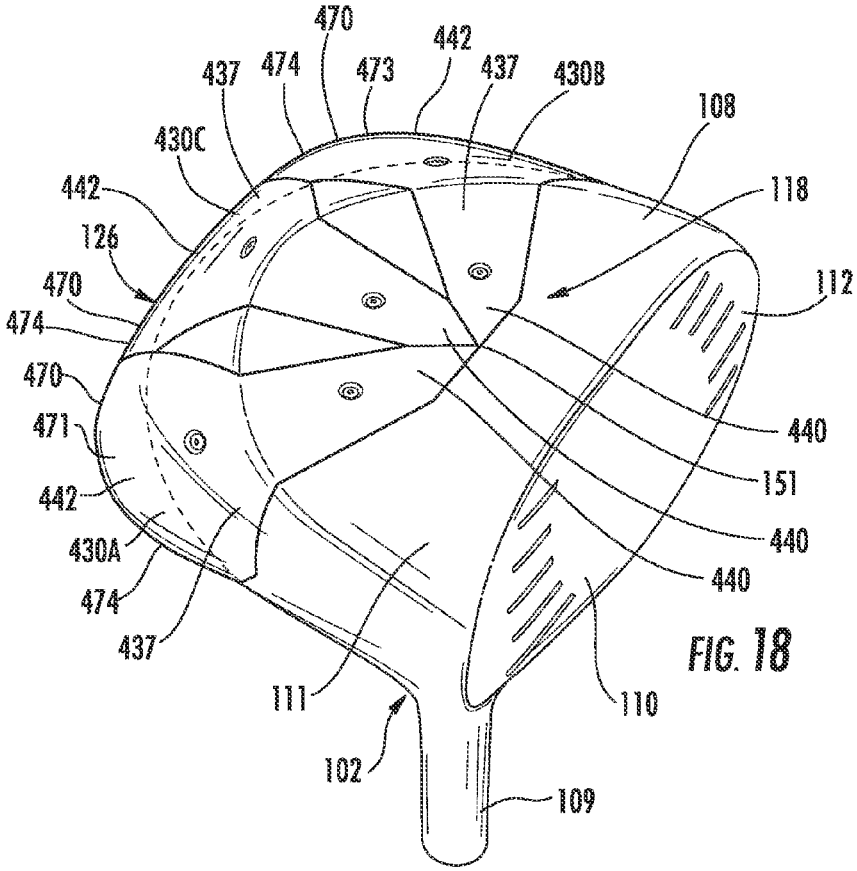
FIG. 18 is a bottom perspective view of the head of FIG. 17.
Figure 19:
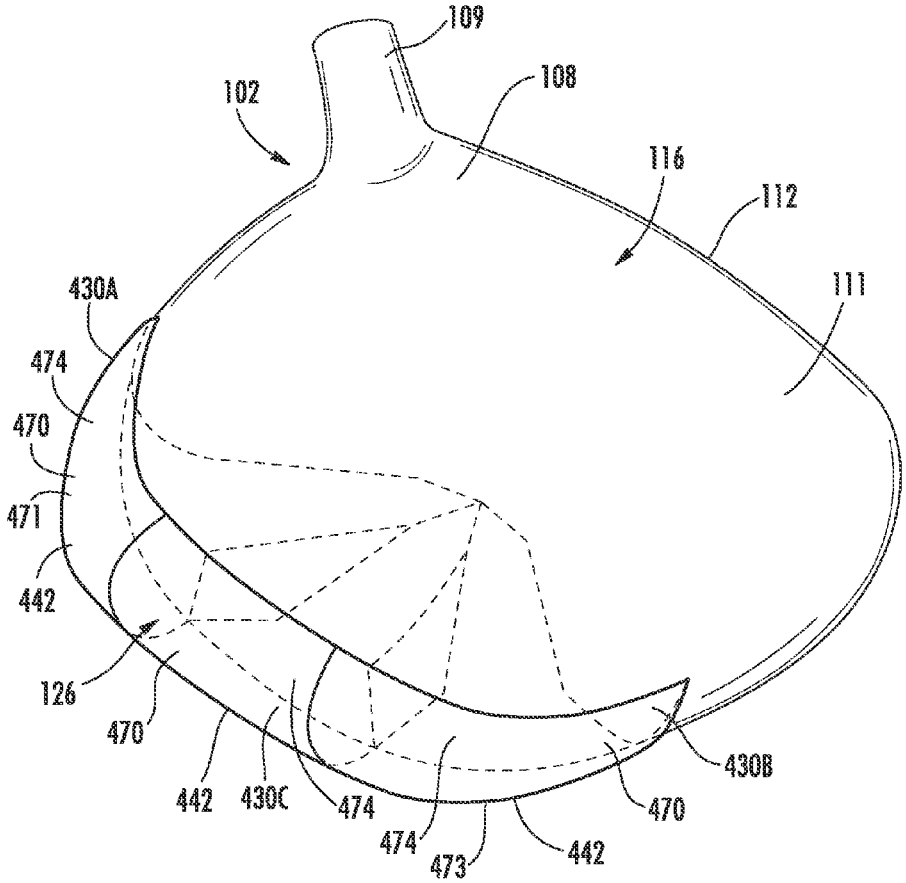
FIG. 19 is a rear perspective view of the head of FIG. 17.
Figure 20:
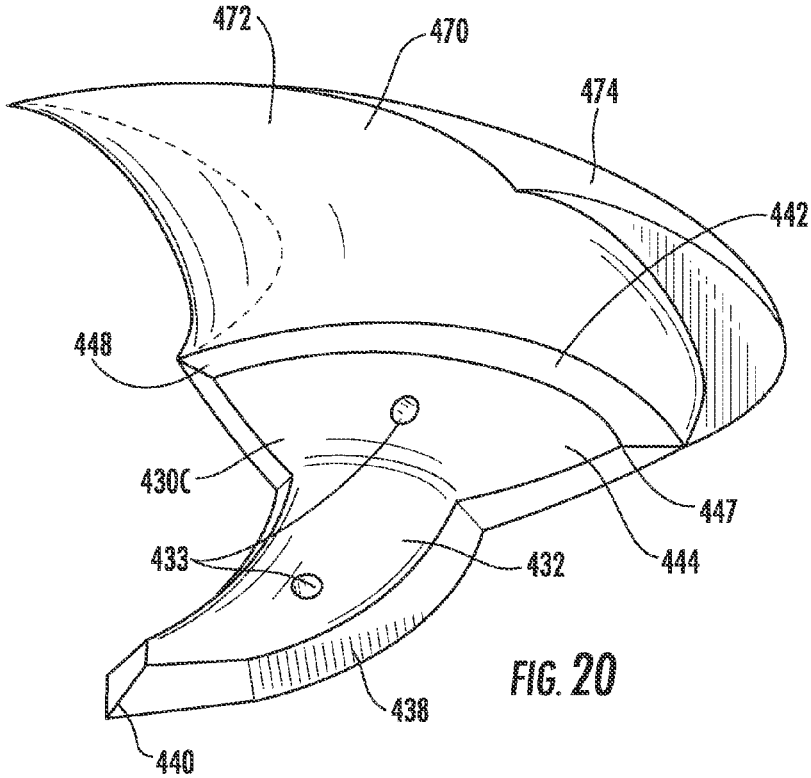
FIG. 20 is a rear perspective view of one of the inserts shown in FIG. 16.
Figure 27:
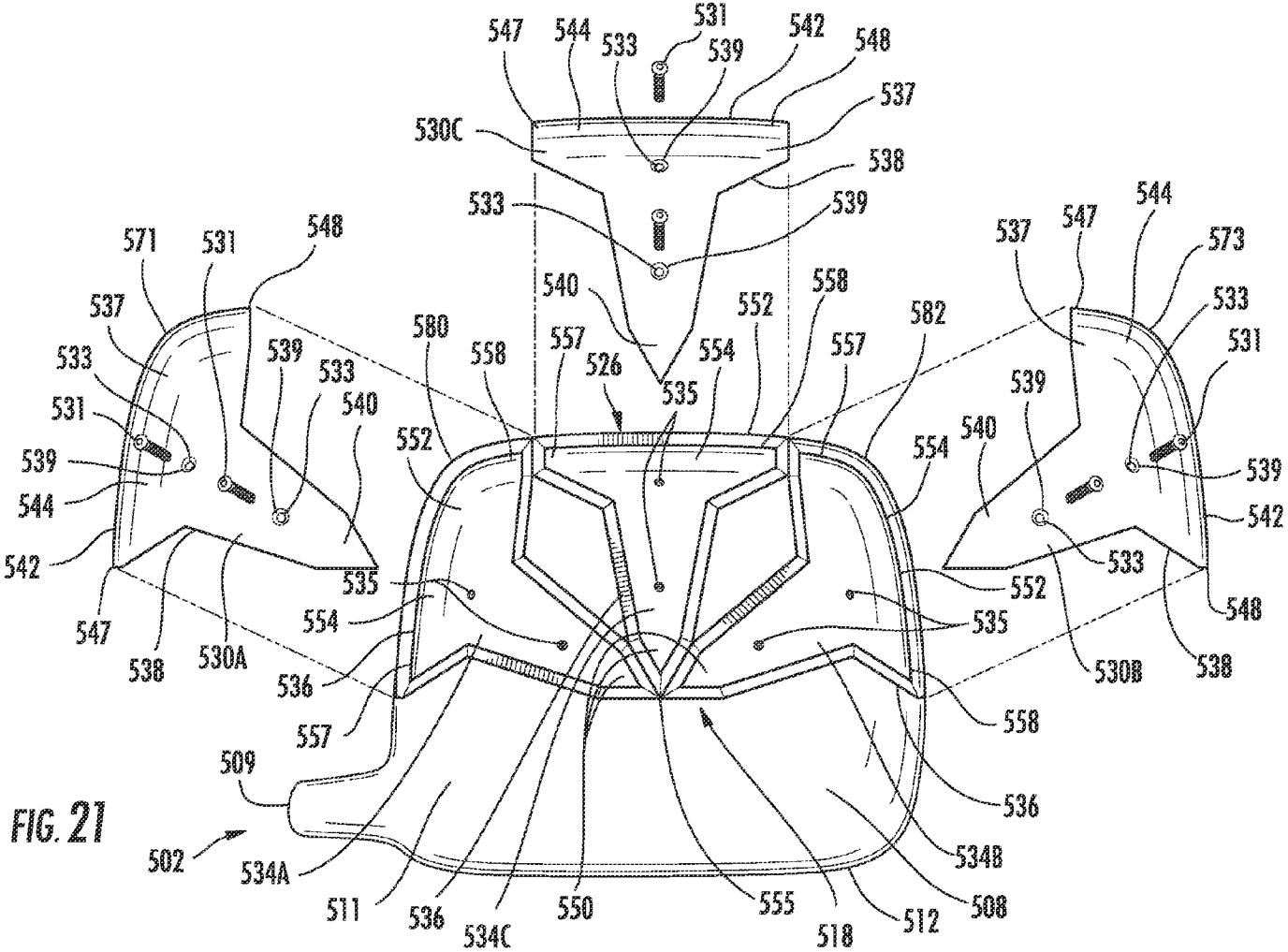

Each of the inserts 430A-C of the embodiment shown in FIGS. 16-20 has a width that tapers outwardly from a first end 440 to a second end 442. In this embodiment, the second end 442 of the each insert 430A-C has a wide portion 444 and the edges 438 of each insert 430A-C taper to a point at the first end 440. The wide portion 444 has opposed first and second sides 447, 448 that define the widest point of the insert 430A-C. As shown in FIGS. 16-19, the wide portions 444 at the second ends 442 of the three inserts 430A-C in this embodiment are shaped differently. Each of the inserts 430A-C has a flange 470 at the second end 442 that is configured to extend around the rear 126 of the head 102. In the embodiment of FIGS. 16-20, each of the flanges 470 has an inner surface 472 that is contoured similarly to the outer surface 111 of the body 108 at the rear 126 of the head 102 and conforms to the shape of the rear 126 of the head 102. The inner surface 472 of the flange 470 of the middle insert 430C is illustrated in FIG. 20, and is shown having a smooth, concavely curved contour. Additionally, each of the flanges 470 has an outer surface 474 that has a contour that changes the shape of the rear 126 of the head 102. FIGS. 18-19 illustrate the contours of the outer surfaces 474 of each of the flanges 470, which form a generally square or rectangular horizontal rear profile. The flange 470 of the left insert 430A has a generally squared contour and profile to form a first generally squared corner 471, and has a generally straight edge on the second side 448. The flange 470 of the right insert 430B has a generally squared contour and profile to form a second generally squared corner 473, and has a generally straight edge on the first side 447. The flange 470 of the middle insert 430C has a more straight profile to form a generally straight profile edge between the corners 471, 473, and has generally straight edges on the first and second sides 447, 448. In this embodiment, each of the flanges 470 is solid, as shown in FIG. 20, which provides mass distributed around the horizontal rear periphery of the head 102, which in turn can increase the MOI of the head 102. However, it is understood that the inserts 430A-C may have flanges 470 that are hollow or otherwise less massive, and that inserts 430A-C with solid flanges 470 may be interchanged with similarly structured inserts (not shown) having hollow flanges 470 to change the weighting of the head 102, as described below. It is also understood that the inserts 430A-C may be formed as a single, integral piece, or the flanges 470 may be connected as separate pieces.

In the embodiment of FIGS. 16-20, the inserts 430A-C are connected and retained to the head 102 by fasteners 131, as similarly described above. Each insert 430A-C has two holes 433 extending through the insert 430A-C to receive the fasteners 131 therethrough, and the body 108 has threaded holes 135 positioned within the recesses 134 to receive the fasteners 131 in threading engagement to retain the fasteners 131 within the holes 433. Additionally, the holes 433 on the inserts 430A-C each have a countersunk portion 439 around the hole 433 to receive the heads of the fasteners 131 therein, so that the fasteners 131 do not extend significantly above the outer surfaces 437 of the inserts 430A-C. In other embodiments, the inserts 430A-C may be removably connected to the head 102 in a different manner, including by a different type of fastener or other removable connection, or may be non-removably connected to the head 102 and/or to each other.

The body 108 and the recesses 134 in the embodiment shown in FIGS. 6-7 are configured similarly to the components described above and shown in FIGS. 1-3. Additionally, in this embodiment, the inserts 430A-C are positioned in a similar manner to the inserts 130 described above with respect to FIGS. 1-5. The inserts 430A-C are positioned in a radiating arrangement on the sole 118 of the body 108, such that the points at the first ends 440 of all of the inserts 430A-C converge to the single point 155 proximate the center of the sole 118. Additionally, the second ends 442 of the inserts 430A-C are positioned around the rear 126 of the head 102 such that the second end 442 of each insert 430A-C is positioned along the area of the head 102 having the largest (maximum) outer periphery. The middle insert 430C is positioned such that the first side 447 of the wide portion 444 is positioned in edge-to-edge relation with the second side 448 of the left insert 430A in FIG. 17, and the second side 448 of the wide portion 444 is positioned in edge-to-edge relation with the first side 447 of the right insert 430B in FIG. 17.

In the embodiment illustrated in FIGS. 16-20, the inserts 430A-C are mounted partially within the recesses 134 such that the outer surfaces 437 of the inserts 430A-C are flush or substantially flush with the outer surface 111 of the body 108, and the heads of the fasteners 131 are either substantially flush with or recessed from the outer surfaces 437 of the inserts 430A-C. As stated above, each of the inserts 430A-C has a projecting portion 441 that is received within the corresponding recess 134 when the inserts 430A-C are connected to the head 102. Additionally, in one embodiment, at least a portion of the outer surfaces 437 of the inserts 430A-C are contoured similarly to the outer surface 111 of the body 108, similarly to the inserts 130 described above with respect to FIGS. 1-5. As shown in the embodiment of FIGS. 16-18 and described above, the rear 126 of the head 102 has a rounded outer contour and profile, and the flanges 470 at the second ends 442 of the inserts 430A-C have inner surfaces 472 that conform to the rounded outer profile of the head 102 and outer surfaces 474 that combine to form a generally square or rectangular horizontal rear profile on the rear 126 of the head 102.

Unlike the inserts 130, 230, 330 described above, each of the inserts 430A-C illustrated in FIGS. 16-20 is different in shape to each of the other inserts 430A-C, and as such, the inserts 430A-C in this embodiment cannot be interchanged with each other. However, as stated above, the inserts 430A-C have similar connecting structure for connection to the outer surface 111 of the body 108. The inserts 430A-C shown in FIGS. 16-20 each have a projecting portion 441 with a boundary formed by chamfered edges 438 of the inner surface 432 that has the same shape as the recesses 134 and is configured to be received in one of the recesses 134, similarly to the inserts 130 described above and shown in FIGS. 1-5. It is understood that, in another embodiment, the inserts 530A-C may be configured for connection of secondary inserts thereto, and may contain one or more cavities for that purpose, similarly to the inserts 230, 330 in FIGS. 6-15.

In one embodiment, one or more inserts having similar structures to the inserts 430A-C in FIGS. 16-20 may be provided with a different weight than the corresponding one of the inserts 430A-C having the similar structure. In this embodiment, the different weights of the inserts 430A-C can be created by using materials having different densities, as described above with respect to the inserts 130 in FIGS. 1-5. As described in further detail below, the inserts 430A-C shown in FIGS. 16-20 can be removed and interchanged with inserts having similar structures and different weights to alter the weight distribution of the head 102. Additionally, the inserts 130, 230, 330 can be removed and replaced by the inserts 430A-C shown in FIGS. 16-20, to change the weighting of the head and/or the external shape, contour, and profile of the head 102.

As described above, the inserts 130, 230, 330, 430A-C in FIGS. 1-20 are all capable of being connected to the head 102 shown in FIGS. 1-3. Accordingly, all of the inserts 130, 230, 330, 430A-C can be interchanged with each other by removing one of the inserts 130, 230, 330, 430A-C from the head 102 and attaching a different one of the inserts 130, 230, 330, 430A-C. It is understood that the inserts 430A-C are configured for connection to the head 102 in specific positions, while the inserts 130, 230, 330 are configured for connection to any of the recesses 134 of the head 102. Interchanging the inserts 130, 230, 330, 430A-C can alter the weighting and/or weight distribution of the head 102 in different manners. As one example, one or more of the inserts 130, 230, 330, 430A-C can be interchanged with other inserts 130, 230, 330, 430A-C having different weights. As another example, one or more of the inserts 130, 230, 330, 430A-C may be interchanged with an insert 230, 330 that enables connection of secondary inserts 250, 350, 360, providing further options for customization. As a further example, one or more of the inserts 130, 230, 330 can be interchanged with inserts 430A-C that can change the profile shape of the head 102 and provide further options for customizing the weight distribution of the head 102. It is understood that the head 102 in FIGS. 1-3 can have two or more different types of inserts 130, 230, 330, 430A-C connected thereto, depending on the desired configuration, and that the inserts 230, 330 may or may not have secondary inserts 250, 350, 360 connected thereto. Still other opportunities are readily recognizable to those skilled in the art.

FIGS. 21-22 illustrate a fourth illustrative embodiment of a head 502 according to the present invention, having inserts 530A-C connected to the body 508 of the head 502. The head 502 depicted in FIGS. 21-22 contains several features in common with the head 102 depicted in FIGS. 1-3, having a body 508 with recesses 534A-C on the outer surface 511. Accordingly, features of the head 502 that are similar to features described above with respect to the head 102 shown in FIGS. 1-3 are referred to herein with similar reference numerals using the "5xx" series of reference numerals. Further, it is understood that some features previously described above may not be described again with respect to this embodiment, and some features may be described only with respect to the differences from similar features in the head 102 of FIGS. 1-3. In the embodiment of FIGS. 21-22, the head 502 has a generally square or rectangular horizontal rear profile, in contrast to the rounded rear profile of the head 102 in FIGS. 1-3. The head 502 has inserts 530A-C connected thereto that generally conform to the rectangular shape of the rear 526 of the head 502.

In the embodiment of in FIGS. 21-22, the head 502 has three different inserts 530A-C connected thereto, and each of the inserts 530A-C is configured to be positioned in a specific position on the body 508. More specifically, the head 502 in FIGS. 21-22 has a left insert 530A connected to the body 508 on the left side of the body 108 as viewed in FIG. 22, a right insert 530B connected to the body 508 on the right side, and a middle insert 530C positioned between the left and right inserts 530A-B. Each of the inserts 530A-C in this embodiment are thin plate members. Additionally, in this embodiment, the body 508 has three recesses 534A-C that are have different shapes and/or configurations. More specifically, the body 508 in FIGS. 21-22 has a left recess 534A configured to receive the left insert 530A, a right recess 534B configured to receive the right insert 530B, and a middle recess 534C configured to receive the middle insert 530C. The inner surfaces (not shown) of the inserts 530A-C are contoured similarly to the outer surface 511 of the body 508 and are cooperatively dimensioned with the outer surface 511 of the body 508. Accordingly, when the inserts 530A-C are connected to the body, as shown in FIG. 22, the inner surfaces of the inserts 530A-C are positioned to confront the outer surface 511 of the body 508 in surface-to-surface arrangement.

Similar to the inserts 130 described above and shown in FIGS. 1-5, each of the inserts 530A-C has a projecting portion (not shown) that is shaped similarly to the corresponding recess 534A-C on the body 508. The projecting portion of each of the inserts 530A-C has a chamfered edge (not shown) around the periphery of the insert 530A-C that is complementary to the chamfered edge 536 around the periphery of the corresponding recess 534A-C on the body 508. When the inserts 530A-C are connected to the body 508, the chamfered edges of the inserts 530A-C confront the chamfered edges 536 of the corresponding recesses 534A-C. The inner surfaces of the inserts 530A-C are not shown in the FIGS., however, each of the inserts 530A-C has a projecting portion (not shown) that is similar in shape to the corresponding recess 534A-C on the head 502. As such, chamfered edges of the projecting portions of the inserts 530A-C are configured to confront the chamfered edges 536 of the recesses 534A-C when the inserts 530A-C are connected to the head 502.

Each of the inserts 530A-C of the embodiment shown in FIGS. 21-22 has a width that tapers outwardly from a first end 540 to a second end 542. In this embodiment, the second end 542 of the each insert 530A-C has a wide portion 544 and the edges 538 of each insert 530A-C taper to a point at the first end 540. The wide portion 544 has opposed first and second sides 547, 548 that define the widest point of the insert 530A-C. As shown in FIGS. 21-22, the wide portions 544 at the second ends 542 of the three inserts 530A-C in this embodiment are shaped differently. The body 508 of the head 502 shown in FIGS. 21-22 has a generally rectangular horizontal rear profile including a first corner 580 and a second corner 582. The left insert 530A has a generally squared contour to conform to the shape of the first corner 580, and the right insert 530B has a generally squared contour to conform to the shape of the second corner. The middle insert 530C has a more straight contour and extends between the inserts 530A-B on the corners 580, 582.

In the embodiment of FIGS. 21-22, the inserts 530A-C are connected and retained to the head 502 by fasteners 531, as similarly described above with respect to the head 102 in FIGS. 1-3. Each insert 530A-C has two holes 533 extending through the insert 530A-C to receive the fasteners 531 therethrough, and the body 508 has threaded holes 535 positioned within the recesses 534A-C to receive the fasteners 531 in threading engagement to retain the fasteners 531 within the holes 533. Additionally, the holes 533 on the inserts 530A-C each have a countersunk portion 539 around the hole 533 to receive the heads of the fasteners 531 therein, so that the fasteners 531 do not extend significantly above the outer surfaces 537 of the inserts 530A-C. In other embodiments, the inserts 530A-C may be removably connected to the head 502 in a different manner, including by a different type of fastener or other removable connection, or may be non-removably connected to the head 502 and/or to each other.

In this embodiment, the inserts 530A-C are positioned in a similar manner to the inserts 130 described above with respect to FIGS. 1-5. The inserts 530A-C are positioned in a radiating arrangement on the sole 518 of the body 508, such that the points at the first ends 540 of all of the inserts 530A-C converge to a single point 555 proximate the center of the sole 518. Additionally, the second ends 542 of the inserts 530A-C are positioned around the rear 526 of the head 502 such that the second end 542 of each insert 530A-C is positioned along the area of the head 502 having the largest (maximum) outer periphery. The middle insert 530C is positioned such that the first side 547 of the wide portion 544 is positioned in edge-to-edge relation with the second side 548 of the left insert 530A in FIG. 22, and the second side 548 of the wide portion 544 is positioned in edge-to-edge relation with the first side 547 of the right insert 530B in FIG. 22.

In the embodiment illustrated in FIGS. 21-22, the inserts 530A-C are mounted at least partially within the recesses 534A-C such that the outer surfaces 537 of the inserts 530A-C are flush or substantially flush with the outer surface 511 of the body 508, and the heads of the fasteners 531 are either substantially flush with or recessed from the outer surfaces 537 of the inserts 530A-C. As stated above, each of the inserts 530A-C has a projecting portion 541 that is received within the corresponding recess 534A-C when the inserts 530A-C are connected to the head 502. Additionally, in one embodiment, at least a portion of the outer surfaces 537 of the inserts 530A-C are contoured similarly to the outer surface 511 of the body 508, similarly to the inserts 130 described above with respect to FIGS. 1-5. As shown in the embodiment of FIGS. 21-22 and described above, the rear 226 of the head 202 has a generally square or rectangular outer contour and profile, and the inner surfaces of the inserts 530A-C conform to the rectangular outer profile of the head 502. Additionally, the outer surfaces 537 of the inserts 530A-C combine to form a generally square or rectangular horizontal rear profile on the rear 526 of the head 502.

Like the inserts 430A-C described above and shown in FIGS. 16-20, each of the inserts 530A-C illustrated in FIGS. 21-22 is different in shape to each of the other inserts 530A-C, and as such, the inserts 530A-C in this embodiment cannot be interchanged with each other. The inserts 530A-C shown in FIGS. 21-22 each have a projecting portion (not shown) with a boundary formed by chamfered edges of the inner surface that has the same shape as the corresponding one of the recesses 534A-C and is configured to be received in the corresponding recess 534A-C. It is understood that, in another embodiment, the inserts 530A-C may be configured for connection of secondary inserts thereto, and may contain one or more cavities for that purpose, similarly to the inserts 230, 330 in FIGS. 6-15.

In one embodiment, one or more inserts having similar structures to the inserts 530A-C in FIGS. 21-22 may be provided with a different weight than the corresponding one of the inserts 530A-C having the similar structure. In this embodiment, the different weights of the inserts 530A-C can be created by using materials having different densities, as described above with respect to the inserts 130 in FIGS. 1-5. As described in further detail below, the inserts 530A-C shown in FIGS. 21-22 can be removed and interchanged with inserts having similar structures and different weights to alter the weight distribution of the head 502. However, the inserts 530A-C are not configured to be interchangeable with the inserts 130, 230, 330, 430A-C described above, as the inserts 530A-C are configured for connection to a head 502 with recesses 534A-C shaped similarly to the inserts 530A-C.

Heads 102, 502 incorporating the inserts 130, 230, 330, 430A-C, 530A-C disclosed herein may be used as a ball striking device or a part thereof. For example, a golf club 100 as shown in FIG. 1 may be manufactured by attaching a shaft or handle 104 to a head that is provided, such as the heads 102, 502 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein.

Manufacturing the heads 102, 502 shown and described herein may include attachment of a backbody member to a face frame member, as described above. Additionally, the head 102, 502, golf club 100, or other ball striking device may be fitted or customized for a person, such as by attaching a shaft 104 thereto having a particular length, flexibility, etc., or by adjusting or interchanging an already attached shaft 104 as described above.

In some embodiments, the inserts 130, 230, 330, 430A-C, 530A-C may be removable from the head 102, 502 and/or interchangeable with another insert that has a similar connecting structure, as described above. Accordingly, a method for customizing the head 102 may include selecting one or more inserts 130, 230, 330, 430A-C, 530A-C for connection to the head 102, 502, interchanging one or more inserts 130, 230, 330, 430A-C, 530A-C currently connected to the head 102, 502 with one or more other inserts 130, 230, 330, 430A-C, 530A-C, and/or removing two or more inserts 130, 230, 330, 430A-C, 530A-C from the head 102 and interchanging them with each other. Additionally, a kit may be provided that includes a head 102, 502 as described above and a plurality of different inserts 130, 230, 330, 430A-C, 530A-C configured for connection to the head 102, 502. Different inserts 130, 230, 330, 430A-C, 530A-C may have different configurations as described herein, such as having different weights and/or densities, and interchanging of inserts 130, 230, 330, 430A-C, 530A-C may affect the weighting properties of the head 102, 502. Such different inserts 130, 230, 330, 430A-C, 530A-C may also be made from different materials, giving the inserts 130, 230, 330, 430A-C, 530A-C different weights, densities, or other different properties. As another example, different inserts 130, 230, 330, 430A-C, 530A-C may have different structural configurations, and can be connected to the head 102, 502 to change the shape and/or appearance of the head 102, 502. Still other variations are possible.

The ball striking devices and heads therefor as described herein provide many benefits and advantages over existing products. For example, as described above, the heads provided herein permit a wide variety of different options for interchangeability to customize the weighting and weight distribution of the head. Additionally, at least some of the inserts provided herein can be used to change the outer profile shape of the head, providing further options for customization of weighting and weight distribution. Such customization may include customizing the weighting and/or weight distribution of the head to performance with a particular golfer's swing. Such customization may also include customizing the weighting and/or weight distribution of the head to produce a specific effect on the flight of a golf ball struck by the face, such as a fade, draw, hook, or slice, to produce a higher or lower trajectory, etc. Such customization may also include customizing the weighting and/or weight distribution of the head to provide a club head that is weighted similarly to another golfer's club, such as the club of a particular professional golfer. Further benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head comprising:

a wood-type face having ball-striking surface configured for striking a ball;

a wood-type body connected to the face and extending rearward from the face to define a cavity bounded by the face and the body, wherein the body and the face enclose a volume of at least 400 cubic centimeters;

a plurality of inserts connected to an outer surface of the body, each of the inserts having a first end and a second end that is wider than the first end, wherein the inserts are positioned in a radiating arrangement on a sole of the body, such that the first ends of the inserts meet proximate a center of the sole and the inserts radiate outwardly from the center of the sole, wherein the plurality of inserts have outer peripheries that are substantially identical in size to enable the inserts to be removed from the body and interchanged with each other, wherein at least one of the inserts has a weight that is greater than at least another one of the inserts; and a plurality of secondary inserts, wherein each of the inserts has at least one secondary insert connected thereto.

2. The wood-type golf club head of claim 1, wherein the head has a peripheral area extending around the face and the body, the peripheral area having a largest outer periphery of the head, wherein the second ends of the inserts are positioned within the peripheral area.

3. The wood-type golf club head of claim 1, wherein the plurality of inserts comprise a first insert, a second insert, and a third insert, wherein the first ends of the first, second, and third inserts converge to the single point, and wherein the second insert is positioned between the first and third inserts such that the second end of the second insert and the second end of the first insert converge to a second point and the second end of the second insert and the second end of the third insert converge to a third point.

4. The wood-type golf club head of claim 1, wherein the outer surface of the body has a curved contour, and wherein each of the inserts has an inner surface that has a curved contour that is cooperatively dimensioned with the outer surface of the body such that the inner surface of each insert engages the outer surface of the body in surface-to-surface engagement.

5. The wood-type golf club head of claim 1, wherein each of the plurality of inserts has at least one cavity therein, and wherein the secondary inserts are received in the cavities.

6. The wood-type golf club head of claim 1, wherein the body has a rounded horizontal rear profile, and wherein the second ends of the inserts each have a rounded contour to conform to the horizontal rear profile of the body.

7. The wood-type golf club head of claim 1, wherein the body includes a plurality of recesses on the outer surface, and wherein each of the inserts is positioned within one of the recesses.

8. The wood-type golf club head of claim 1, wherein the inserts are connected to the body by threaded fasteners.

9. A wood-type golf club comprising the wood-type golf club head of claim 1 and a shaft connected thereto.

10. The golf club head of claim 1, wherein each insert has a wide portion located at the second end and defining a maximum width of the insert and an arm extending from the wide portion to the first end, wherein the arm has a length measured transversely to the width that is greater than a length of the wide portion, and wherein the arm has a width that is smaller than the maximum width defined by the wide portion.

11. A golf club head comprising:

a face having a ball-striking surface configured for striking a ball;

a body connected to the face, the body having an outer surface;

a plurality of inserts connected to the outer surface of the body, wherein the plurality of inserts have outer peripheries that are substantially identical in size to enable the inserts to be removed from the body and interchanged with each other, and wherein at least one of the inserts has a weight that is greater than at least another one of the inserts, wherein the plurality of inserts comprise a first insert, a second insert, and a third insert, wherein the first, second, and third inserts each have first ends that converge to a single point and second ends opposite the first ends, and wherein the second insert is positioned between the first and third inserts, and wherein each insert has a wide portion located at the second end and defining a maximum width of the insert and an arm extending from the wide portion to the first end, wherein the arm has a length measured transversely to the width that is greater than a length of the wide portion, and wherein the arm has a width that is smaller than the maximum width defined by the wide portion; and a plurality of secondary inserts, wherein each of the inserts has at least one secondary insert connected thereto.

12. The golf club head of claim 11, wherein the inserts are positioned in a radiating arrangement on a sole of the body, such that the first ends of the inserts are positioned proximate the single point and the inserts radiate outwardly from the single point.

13. The golf club head of claim 11, wherein the body has a plurality of recesses on the outer surface, wherein each of the inserts is received in one of the recesses, and wherein the recesses are substantially identical in size to enable each of the inserts to be received in any of the recesses.

14. The golf club head of claim 11, wherein each of the inserts has at least one cavity therein, and the secondary inserts are received in the cavities.

15. The golf club head of claim 11, the plurality of secondary inserts are substantially identical in size, to enable the secondary inserts to be interchanged with each other.

16. The golf club head of claim 15, wherein each of the inserts has a cavity therein, and the secondary inserts are received in the cavities, and wherein the cavities are substantially identical in size to enable each of the secondary inserts to be received in any of the cavities.

17. The golf club head of claim 11, further comprising a first group of the secondary inserts and a second group of the secondary inserts, wherein the secondary inserts of the first group are substantially identical in size, and the secondary inserts of the second group are substantially identical in size, and wherein each of the inserts has one secondary insert of the first group and one secondary insert of the second group connected thereto.

18. The golf club head of claim 17, wherein each of the inserts has a first cavity and a second cavity therein, wherein the secondary inserts of the first group are received in the first cavities, and the secondary inserts of the second group are received in the second cavities, and wherein each of the first cavities are substantially identical in size and each of the second cavities are substantially identical in size to enable each of the secondary inserts of the first group to be received in any of the first cavities and each of the secondary inserts of the second group to be received in any of the second cavities.

19. A golf club comprising the golf club head of claim 11 and a shaft connected thereto.

20. The golf club head of claim 11, wherein the wide portion of the second insert and the wide portion of the first insert converge to a second point and the wide portion of the second insert and the wide portion of the third insert converge to a third point.

21. A golf club head comprising:

a face having a ball-striking surface configured for striking a ball;

a body connected to the face, the body having an outer surface;

a removable primary insert connected to the outer surface of the body, the primary insert having a first hole extending therethrough;

a secondary insert connected to the primary insert, the secondary insert having a second hole extending therethrough; and a fastener extending into and through the first hole and from the first hole into and through the second hole, such that the fastener engages the secondary insert and forces the secondary insert into engagement with the primary insert to removably connect the secondary insert to the primary insert and to removably connect the primary and secondary inserts to the body.

22. The golf club head of claim 21, wherein the primary insert has a cavity therein, and the secondary insert is received within the cavity, and wherein the fastener retains the secondary insert within the cavity.

23. The golf club head of claim 21, further comprising a second secondary insert connected to the primary insert, the primary insert having a third hole extending therethrough, and the second secondary insert having a fourth hole extending therethrough, further comprising a second fastener extending through the third hole and the fourth hole to removably connect the second secondary insert to the primary insert and to removably connect the primary and second secondary inserts to the body.

24. The golf club head of claim 23, wherein the primary insert has two cavities therein, and the secondary inserts are received within the cavities.

25. A golf club comprising the golf club head of claim 21 and a shaft connected thereto.

26. The golf club head of claim 21, further comprising:

a plurality of removable primary inserts connected to the outer surface of the body, each primary insert having a first hole extending therethrough;

a plurality of secondary inserts, each connected to one of the primary inserts, each secondary insert having a second hole extending therethrough; and a plurality of fasteners removably connecting the secondary inserts to the primary inserts and removably connecting the primary and secondary inserts to the body, such that each fastener extends into and through the first hole and from the first hole into and through the second hole, such that the fastener engages the secondary insert and forces the secondary insert into engagement with the primary insert to removably connect the secondary insert to the primary insert and to removably connect the primary and secondary inserts to the body.

27. A golf club head comprising:

a face having a ball-striking surface configured for striking a ball;

a body connected to the face, the body having an outer surface having a curved contour;

a plurality of inserts connected to the outer surface of the body, wherein each of the inserts comprises a thin plate member having an inner surface that has a curved contour that is cooperatively dimensioned with the outer surface of the body such that the inner surface of each insert engages the outer surface of the body in surface-to-surface engagement, wherein the inserts are positioned in a radiating arrangement on a sole of the body, such that the inserts have first ends positioned proximate a center of the sole and second ends proximate a rear periphery of the body, and wherein each insert has a wide portion located at the second end and defining a maximum width of the insert and an arm extending from the wide portion to the first end, wherein the arm has a length measured transversely to the width that is greater than a length of the wide portion, and wherein the arm has a width that is smaller than the maximum width defined by the wide portion; and a plurality of secondary inserts, wherein each of the inserts has at least one secondary insert connected thereto.

28. The golf club head of claim 27, wherein the body has a rounded horizontal rear profile, and wherein the inserts each have a rounded contour to conform to the horizontal rear profile of the body.

29. The golf club head of claim 27, wherein the body has a generally rectangular horizontal rear profile including a first corner and a second corner, and wherein the plurality of inserts include at least a first insert and a second insert, the first insert having a generally squared contour to conform to the first corner, and the second insert having a generally squared contour to conform to the second corner.

30. The golf club head of claim 27, wherein the body has a rounded horizontal rear profile, and wherein the plurality of inserts include at least a first insert and a second insert, the first insert having a generally squared contour to form a first generally squared corner, and the second insert having a generally squared contour to form a second generally squared corner, giving the head a generally rectangular horizontal rear profile.

31. A golf club comprising the golf club head of claim 27 and a shaft connected thereto.

32. The golf club head of claim 27, wherein the first ends of the inserts meet proximate a center of the sole and the inserts radiate outwardly from the center of the sole.

33. A golf club head comprising:

a face having a ball-striking surface configured for striking a ball;

a body connected to the face, the body having an outer surface;

a removable primary insert connected to the outer surface of the body, the primary insert having a first hole extending therethrough;

a secondary insert connected to the primary insert, the secondary insert having a second hole extending therethrough;

a fastener extending into and through the first hole and from the first hole into and through the second hole, such that the fastener engages the secondary insert and forces the secondary insert into engagement with the primary insert to removably connect the secondary insert to the primary insert and to removably connect the primary and secondary inserts to the body;

a second secondary insert connected to the primary insert, the primary insert having a third hole extending therethrough, and the second secondary insert having a fourth hole extending therethrough; and a second fastener extending through the third hole and the fourth hole to removably connect the second secondary insert to the primary insert and to removably connect the primary and second secondary inserts to the body.

34. The golf club head of claim 33, wherein the primary insert has two cavities therein, and the secondary inserts are received within the cavities.

* * * * *